US008902211B2

(12) United States Patent
Cheng et al.

(10) Patent No.: US 8,902,211 B2
(45) Date of Patent: Dec. 2, 2014

(54) CONTROL DEVICE AND CONTROL METHOD FOR DISPLAY PANEL

(71) Applicant: Orise Technology Co., Ltd., Hsinchu (TW)

(72) Inventors: Yen-Cheng Cheng, Hsinchu (TW); Chien-Chun Huang, Hsinchu (TW); Kuan-Han Chen, Hsinchu (TW)

(73) Assignee: Orise Technology Co., Ltd., Hsinchu (TW)

( * ) Notice: Subject to any disclaimer, the term of this patent is extended or adjusted under 35 U.S.C. 154(b) by 217 days.

(21) Appl. No.: 13/727,712

(22) Filed: Dec. 27, 2012

(65) Prior Publication Data

US 2013/0169617 A1 Jul. 4, 2013

(30) Foreign Application Priority Data

Dec. 30, 2011 (TW) ..... 100150012 A

(51) Int. Cl.
*G09G 3/36* (2006.01)

(52) U.S. Cl.
CPC ..... *G09G 3/36* (2013.01); *G09G 3/3614* (2013.01); *G09G 2310/0248* (2013.01); *G09G 2330/023* (2013.01)
USPC ..... 345/212; 345/690; 345/209

(58) Field of Classification Search
None
See application file for complete search history.

(56) References Cited

U.S. PATENT DOCUMENTS 6,307,681 B1 * 10/2001 Aoki et al. ..... 359/645
6,650,310 B2 11/2003 Yoon
7,911,437 B1 * 3/2011 Bell ..... 345/100
7,986,288 B2 * 7/2011 Jang et al. ..... 345/87
2003/0071773 A1 * 4/2003 Ohtani et al. ..... 345/87
2003/0179164 A1 * 9/2003 Shin et al. ..... 345/76
2004/0252116 A1 * 12/2004 Tobita ..... 345/211
2005/0007324 A1 * 1/2005 Inada ..... 345/87
2006/0103618 A1 * 5/2006 Miura ..... 345/96
2006/0119596 A1 * 6/2006 Lin ..... 345/211
2006/0262069 A1 * 11/2006 Do et al. ..... 345/98
2006/0274020 A1 * 12/2006 Sung et al. ..... 345/100
2006/0290638 A1 * 12/2006 Kang et al. ..... 345/98
2007/0285355 A1 * 12/2007 Bourgoin et al. ..... 345/60
2007/0290983 A1 * 12/2007 Kim et al. ..... 345/100
2008/0055293 A1 * 3/2008 Kuo et al. ..... 345/204
2008/0068316 A1 * 3/2008 Maekawa ..... 345/87
2008/0180174 A1 * 7/2008 Kim et al. ..... 330/253
2008/0204386 A1 * 8/2008 Park ..... 345/84
2008/0284771 A1 * 11/2008 Matsuki ..... 345/211
2009/0115775 A1 * 5/2009 Chuang et al. ..... 345/215
2009/0195719 A1 * 8/2009 Kim et al. ..... 349/39
2009/0201283 A1 * 8/2009 Inokuchi et al. ..... 345/212

(Continued)

*Primary Examiner* — Seokyun Moon
*Assistant Examiner* — Josemarie G Acha, III
(74) *Attorney, Agent, or Firm* — WPAT, PC; Justin King

(57) ABSTRACT

A charge-sharing control method for a display panel includes the following steps. Firstly, a first switch set is turned on, so that a first voltage driving unit provides a first positive driving voltage to a first data line and a second voltage driving unit provides a first negative driving voltage to a second data line. Then, a second switch set is turned on, so that a first charge storage unit has a positive common voltage and a second charge storage unit has a negative common voltage. Then, a third switch set is turned on, so that the first data line and the second data line are electrically connected with a ground voltage. After a polarity inversion, the second data line is charged according to a first comparison result and the first data line is discharged according to a second comparison result.

18 Claims, 14 Drawing Sheets

(56) References Cited

U.S. PATENT DOCUMENTS

| | | | | |
|---|---|---|---|---|
| 2009/0231259 | A1* | 9/2009 | Yu et al. | 345/92 |
| 2010/0134172 | A1* | 6/2010 | Hsu et al. | 327/296 |
| 2010/0149171 | A1* | 6/2010 | Huang et al. | 345/214 |
| 2010/0164929 | A1* | 7/2010 | Chen et al. | 345/211 |
| 2010/0188389 | A1* | 7/2010 | Hsu et al. | 345/212 |
| 2010/0289791 | A1* | 11/2010 | Weng | 345/213 |
| 2011/0012671 | A1* | 1/2011 | Chuang et al. | 327/536 |
| 2011/0032245 | A1* | 2/2011 | Inokuchi | 345/212 |
| 2011/0050665 | A1* | 3/2011 | Tsai et al. | 345/211 |
| 2011/0050677 | A1* | 3/2011 | Tsai et al. | 345/213 |
| 2011/0050680 | A1* | 3/2011 | Chung et al. | 345/214 |
| 2011/0090212 | A1* | 4/2011 | Han et al. | 345/212 |
| 2011/0164006 | A1* | 7/2011 | Son et al. | 345/204 |
| 2011/0316901 | A1* | 12/2011 | Park et al. | 345/690 |
| 2012/0153996 | A1* | 6/2012 | Su et al. | 327/109 |
| 2012/0169783 | A1* | 7/2012 | Park | 345/690 |
| 2012/0188224 | A1* | 7/2012 | Lee et al. | 345/214 |
| 2012/0280961 | A1* | 11/2012 | Son et al. | 345/211 |
| 2012/0313892 | A1* | 12/2012 | Philipp | 345/174 |
| 2012/0320021 | A1* | 12/2012 | Chang et al. | 345/211 |
| 2012/0326734 | A1* | 12/2012 | Cho et al. | 324/684 |
| 2013/0021314 | A1* | 1/2013 | Wu | 345/212 |
| 2013/0120349 | A1* | 5/2013 | Oh | 345/212 |

* cited by examiner

CONTROL DEVICE AND CONTROL METHOD FOR DISPLAY PANEL

This application claims the benefit of Taiwan Patent Application No. 100150012, filed Dec. 30, 2011, the subject matter of which is incorporated herein by reference.

FIELD OF THE INVENTION

The present invention relates to a control device and a control method for a display panel, and more particularly to a control device and a control method for selectively charging or discharging data lines of a display panel according to a voltage comparison result.

BACKGROUND OF THE INVENTION

Flat display devices such as liquid crystal displays are widely used in various consumer electronic products. In a case that the flat display devices are applied to portable electronic devices, it is a very important issue to reduce the power consumption.

A liquid crystal device is a flat display device that uses the light modulating properties of liquid crystal molecules. By changing an electric field, the orientation of the liquid crystal molecules is changed. Consequently, the polarization of the incident light is changed to produce a corresponding image. That is, for displaying the contents of the image on the flat display device, the image frame is shown on the display panel according to the polarity inversion of the data lines or the pixel units.

FIGS. 1A~1C are schematic circuit diagrams illustrating a control circuit for controlling the operations of a display panel according to the prior art. For clarification, the pixel units of the display panel are not shown in the following drawings, and only some of the data lines are shown. The other components (e.g. the polarity control lines and the timing controller) of the display panel are not described herein.

For clarification and brevity, only four data lines and four voltage driving units are shown in FIGS. 1A~1C. From top to bottom of the left side of these drawings, the control circuit includes a first voltage driving unit 111, a second voltage driving unit 112, a third voltage driving unit 113, and a fourth voltage driving unit 114. Moreover, from top to bottom of the right side of these drawings, the control circuit includes a first data line 101, a second data line 102, a third data line 103, and a fourth data line 104.

Moreover, a first period before the polarity inversion includes a first stage I and a second stage II, and a second period after the polarity inversion includes a third stage III.

As shown in FIG. 1A, the display panel is operated in the first stage I. During the first stage I, the first data line 101 and the third data line 103 are connected with the first voltage driving unit 111 and the third voltage driving unit 113, respectively. Both of the first voltage driving unit 111 and the third voltage driving unit 113 provide positive driving voltages. On the other hand, the second data line 102 and the fourth data line 104 are connected with the second voltage driving unit 112 and the fourth voltage driving unit 114, respectively. Both of the second voltage driving unit 112 and the fourth voltage driving unit 114 provide negative driving voltages.

During the process of controlling the display panel, the polarities providing to the pixel units by respective data lines may be switched between positive polarities and negative polarities.

As shown in FIG. 1B, the display panel is operated in the second stage II. Before the polarity inversion, these data lines are connected with a ground voltage. Consequently, the voltages of all data lines are 0 volt in the second stage II.

As shown in FIG. 1C, the display panel is operated in the third stage III. The connections between the data lines and the voltage driving units in the third stage III are different from the ones in the first stage I. In the third stage III, the data lines and the voltage driving units are connected with each other in a staggered arrangement.

That is, as shown in FIG. 1C, the first data line 101 and the third data line 103 are connected with the second voltage driving unit 112 and the fourth voltage driving unit 114, respectively. Both of the second voltage driving unit 112 and the fourth voltage driving unit 114 provide negative driving voltages. On the other hand, the second data line 102 and the fourth data line 104 are connected with the first voltage driving unit 111 and the third voltage driving unit 113, respectively. Both of the first voltage driving unit 111 and the third voltage driving unit 113 provide positive driving voltages.

FIG. 1D is a schematic timing waveform diagram illustrating associated voltages of the first data line in different stages according to FIGS. 1A~1C. In the first stage I, since the first data line 101 is electrically connected with the first voltage driving unit 111, which provides the positive driving voltage (e.g. +5V), the voltage applied to the first data line 101 is maintained at +5V.

For the subsequent polarity inversion, the data lines with the positive driving voltage are discharged. That is, in the second stage II, the first data line 101 is connected with the ground voltage. Consequently, the voltage of the first data line 101 is 0 volt.

In the third stage III, since the first data line 101 is electrically connected with the second voltage driving unit 112, which provides the negative driving voltage (e.g. −5V), the voltage applied to the first data line 101 is decreased to −5V.

As shown in FIG. 1D, in the beginning of the third stage III, the magnitude of the current flowing through the first data line 101 is abruptly changed and a large transient negative current is generated. Consequently, the overall average current value is increased and the power consumption is increased. After the third stage III, the polarity inversion is repeatedly performed. Before the polarity inversion, all data lines should be connected with the ground voltage too. Then, the driving voltages with different polarities are provided to the data lines.

FIG. 1E is a schematic timing waveform diagram illustrating associated voltages of the second data line in different stages according to FIGS. 1A~1C. Since the first data line 101 and the second data line 102 are connected with the voltage driving units with different polarities in the first stage I and the third stage III, the voltage change of FIG. 1E and the voltage change of FIG. 1D are opposite.

Similarly, as shown in FIG. 1E, in the end of the second stage II and in the beginning of the third stage III, the magnitude of the current flowing through the second data line 102 is abruptly changed and a large transient positive current is generated. Consequently, the overall average current value is increased and the power consumption is increased.

From the above discussions in FIGS. 1A~1E, the driving voltage of the data line is switched back and forth between the positive polarity and the negative polarity. Before each polarity inversion, all data lines should be connected with the ground voltage. In such way, the driving voltage provided by the voltage driving unit should increase or decrease the voltage of the data line from 0 volt during each polarity inversion. Under this circumstance, the electric energy is gratuitously wasted.

SUMMARY OF THE INVENTION

A first embodiment of the present invention provides a charge-sharing control method for use in a control device of a display panel. The control device includes a first data line, a second data line, a first voltage driving unit, a second voltage driving unit, a first charge storage unit, a second charge storage unit, a first switch set, a second switch set and a third switch set. A first positive driving voltage and a first negative driving voltage are respectively provided by the first voltage driving unit and the second voltage driving unit before a polarity inversion. A second positive driving voltage and a second negative driving voltage are respectively provided by the first voltage driving unit and the second voltage driving unit after the polarity inversion, The charge-sharing control method includes the following steps. Firstly, the first switch set is turned on. After the first switch set is turned on, the first voltage driving unit provides the first positive driving voltage to the first data line and the second voltage driving unit provides the first negative driving voltage to the second data line. Then, the second switch set is turned on. After the second switch set is turned on, the first data line with the first positive driving voltage transmits positive charges to the first charge storage unit such that the first charge storage unit has a positive common voltage, and the second data line with the first negative driving voltage transmits negative charges to the second charge storage unit such that the second charge storage unit has a negative common voltage. Then, the second data line is charged or the first data line is discharged. If a comparison between a voltage of the second data line and the second positive driving voltage complies with a first comparison result after the polarity inversion, the second data line is charged. Whereas, if a comparison between a voltage of the first data line and the second negative driving voltage complies with a second comparison result after the polarity inversion, the first data line is discharged.

A second embodiment of the present invention provides a control device of a display panel. The control device includes a plurality of switch sets, a first data line, a second data line, a first voltage driving unit, a second voltage driving unit, a first charge storage unit, a first comparison circuit, a second charge storage unit, and a second comparison circuit. The plurality of switch sets includes a first switch set, a second switch set and a third switch set, which are sequentially turned on before a polarity inversion is performed. Each of the first switch set, the second switch set and the third switch set includes a first sub-switch and a second sub-switch. First ends of the first sub-switches are electrically connected with a first node. First ends of the second sub-switches are electrically connected with a second node. The first data line is electrically connected with the first and the second nodes before and after the polarity inversion, respectively. The second data line is electrically connected with the second and the first nodes before and after the polarity inversion. The first voltage driving unit is electrically connected with a second end of the first sub-switch of the first switch set. The first voltage driving unit generates a first and a second positive driving voltages before and after the polarity inversion, respectively. The second voltage driving unit is electrically connected with a second end of the second sub-switch of the first switch set. The second voltage driving unit generates a first and a second negative driving voltages before and after the polarity inversion, respectively. The first charge storage unit is electrically connected with a second end of the first sub-switch of the second switch set. When the second switch set is turned on, the first charge storage unit acquires a positive common voltage. The first comparison circuit is electrically connected with the first node, the first voltage driving unit and the first charge storage unit. If a comparison between a voltage of the second data line and the second positive driving voltage complies with a first comparison result after the polarity inversion, the positive common voltage is transmitted to the first node through the first comparison circuit so as to charge the second data line. The second charge storage unit is electrically connected with a second end of the second sub-switch of the second switch set. When the second switch set is turned on, the second charge storage unit acquires a negative common voltage. The second comparison circuit is electrically connected with the second node, the second voltage driving unit and the second charge storage unit. After the polarity inversion, if a comparison between a voltage of the first data line and the second negative driving voltage complies with a second comparison result, the negative common voltage is transmitted to the second node through the second comparison circuit so as to discharge the first data line.

A third embodiment of the present invention provides a charge-sharing control method for use in a control device of a display panel. The control device includes a first data line, a second data line, a first voltage driving unit, a second voltage driving unit, a first charge storage unit, a second charge storage unit, a first switch set, a second switch set, a third switch set, a fourth switch set, a first amplifier and a second amplifier. A first positive driving voltage and a first negative driving voltage are respectively provided by the first and the second voltage driving units before a polarity inversion. A second positive driving voltage and a second negative driving voltage are respectively provided by the first and the second voltage driving units after the polarity inversion. The charge-sharing control method includes the following steps. Firstly, the first switch set is turned on. After the first switch set is turned on, the first voltage driving unit provides the first positive driving voltage to the first data line and the second voltage driving unit provides the first negative driving voltage to the second data line. Then, the second switch set is turned on. After the second switch set is turned on, the first data line with the first positive driving voltage transmits positive charges to the first charge storage unit such that the first charge storage unit has a positive common voltage, and the second data line with the first negative driving voltage transmits negative charges to the second charge storage unit such that the second charge storage unit has a negative common voltage. Then, the third switch set is turned on, so that the first data line and the second data line are electrically connected with a ground voltage. Then, a first comparison switch and a second comparison switch of the fourth switch set are turned on after the polarity inversion. After that, the first amplifier is driven according to a voltage of the second data line and the second positive driving voltage so as to charge the second data line, and the second amplifier is driven according to a voltage of the first data line and the second negative driving voltage so as to discharge the first data line.

A fourth embodiment of the present invention provides a control device of a display panel. The control device includes a plurality of switch sets, a first data line, a second data line, a first voltage driving unit, a second voltage driving unit, a first charge storage unit, a second charge storage unit, a first amplifier, and a second amplifier. The plurality of switch sets include a first switch set, a second switch set and a third switch set. Each of the first switch set, the second switch set and the third switch set includes a first sub-switch and a second sub-switch. The first sub-switches are electrically connected with a first node. The second sub-switches are electrically connected with a second node. Both the first and the second data lines are electrically connected with the display panel. The first data line is electrically connected with the first and the second nodes before and after the polarity inversion, respectively. The first data line has a ground voltage after the third switch set is turned on. The second data line is electrically connected with the second and the first nodes before and after the polarity inversion. The second data line has the ground voltage after the third switch set is turned on. The first voltage driving unit is electrically connected with the first sub-switch of the first switch set. The first voltage driving unit provides a first positive driving voltage to the first data line through the first node before the polarity inversion. The first voltage driving unit provides a second positive driving voltage to the second data line through the first node after the polarity inversion. The second voltage driving unit is electrically connected with the second sub-switch of the first switch set. The second voltage driving unit provides a first negative driving voltage to the second data line through the second node before the polarity inversion is performed. The second voltage driving unit provides a second negative driving voltage to the first data line through the second node after the polarity inversion is performed. The first charge storage unit is electrically connected with the first sub-switch of the second switch set. When the second switch set is turned on, positive charges are transmitted from the first data line to the first charge storage unit, so that the first charge storage unit has a positive common voltage. The second charge storage unit is electrically connected with the second sub-switch of the second switch set. When the second switch set is turned on, negative charges are transmitted from the second data line to the second charge storage unit, so that the second charge storage unit has a negative common voltage. The first amplifier is electrically connected with the first node and a first comparison switch. When the first comparison switch is turned on, the first amplifier is electrically connected with the first charge storage unit. The first amplifier is enabled according to a voltage of the second data line and the second positive driving voltage so as to charge the second data line. The second amplifier is electrically connected with the second node and a second comparison switch. When the second comparison switch is turned on, the second amplifier is electrically connected with the second charge storage unit. The second amplifier is enabled according to a voltage of the first data line and the second negative driving voltage so as to discharge the first data line.

Numerous objects, features and advantages of the present invention will be readily apparent upon a reading of the following detailed description of embodiments of the present invention when taken in conjunction with the accompanying drawings. However, the drawings employed herein are for the purpose of descriptions and should not be regarded as limiting.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

Figure 1A:
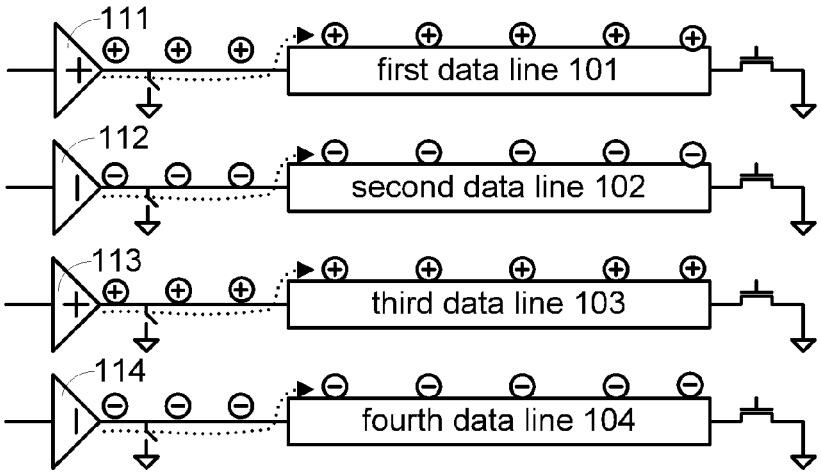
FIG. 1A (PRIOR ART)
FIGS. 1A~1C are schematic circuit diagrams illustrating a control circuit for controlling the operations of a display panel according to the prior art.

For reducing the power consumption during the polarity inversion of the data line, the control circuit for the display panel usually has a charge-sharing function.

Hereinafter, a charging-sharing controlling method of the present invention will be illustrated with reference to FIGS.

2A~2E. For clarification and illustration, the layout arrangement of the data lines and the voltage driving unit is similar to that of FIG. 1.

From top to bottom of the left side of these drawings, the control circuit includes a first voltage driving unit 211, a second voltage driving unit 212, a third voltage driving unit 213, and a fourth voltage driving unit 214. Moreover, from top to bottom of the right side of these drawings, the control circuit includes a first data line 201, a second data line 202, a third data line 203, and a fourth data line 204.

In this embodiment, a first period before the polarity inversion includes three stages (i.e. a first stage I, a second stage II and a third stage III), and a second period after the polarity inversion includes two stages (i.e. a fourth stage IV and a fifth voltage V).

Figure 1B:
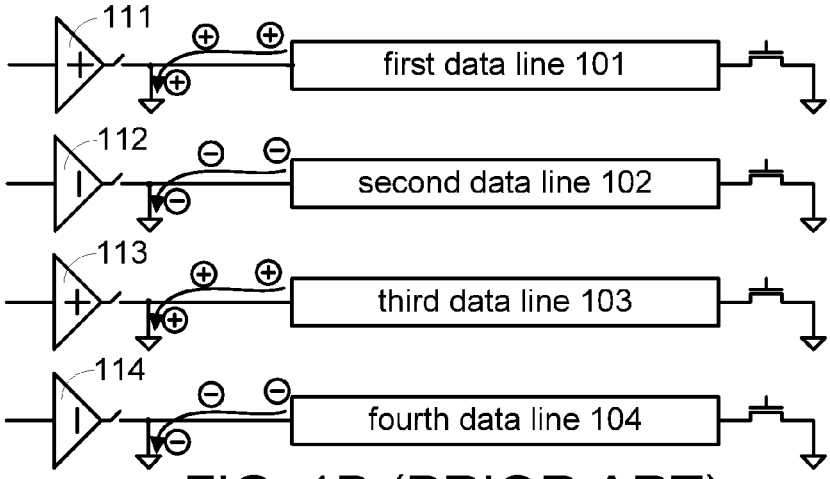
FIG. 1B (PRIOR ART)
Figure 1C:
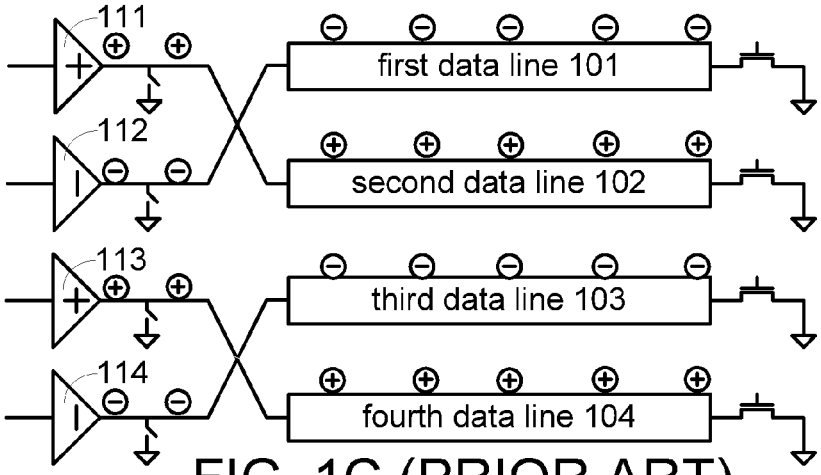
FIG. 1C (PRIOR ART)
Figure 1D:
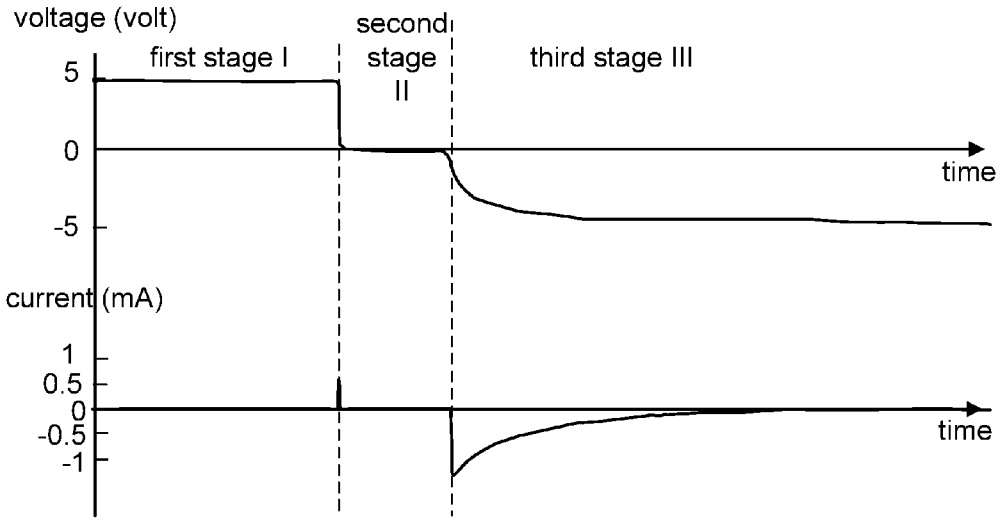
FIG. 1D (PRIOR ART)
FIG. 1D is a schematic timing waveform diagram illustrating associated voltages applied to the first data line of the control circuit of FIGS. 1A~1C in different stages.
Figure 1E:
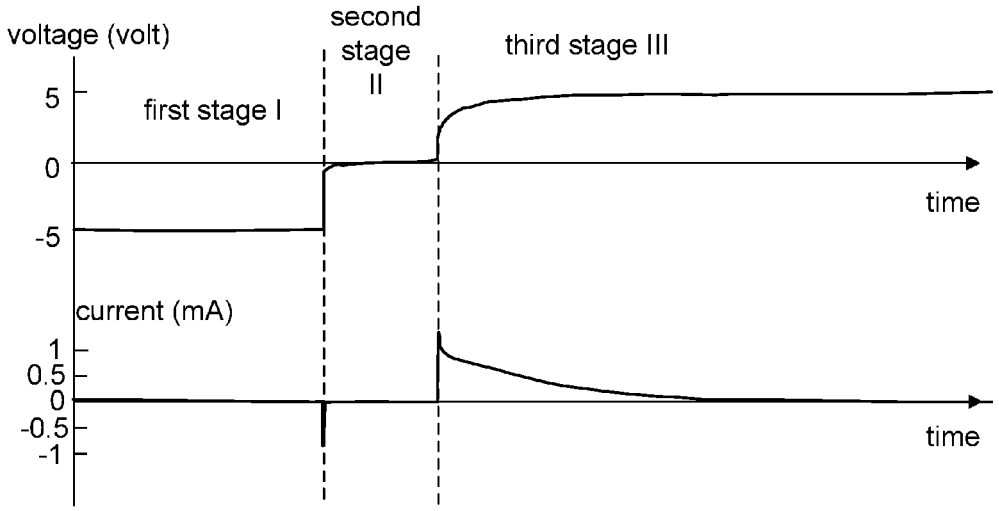
FIG. 1E (PRIOR ART)
FIG. 1E is a schematic timing waveform diagram illustrating associated voltages applied to the second data line of the control circuit of FIGS. 1A~1C in different stages.

In comparison with FIGS. 1A~1C, the control circuit in FIGS. 2A~2E includes more switch sets. In addition to the original switch set which is connected between the voltage driving unit and the ground voltage, each data line has two additional switch sets respectively connected with two capacitors. In a case that the two additional switch sets are turned on, a first charge storage unit (first capacitor) Cp and a second charge storage unit (second capacitor) Cn are respectively and electrically connected with the data lines which provide the positive driving voltage and the negative driving voltage.

For clarification, the switch sets as shown in FIGS. 2A~2E are designated by different numeral references. The operations of these switch sets will be illustrated in more details as follows.

The first switch set (1) is turned on when the display panel is operated in the first stage I and the fifth stage V. When the first switch set (1) is turned on, voltage driving units and their corresponding data lines are conducted.

The second switch set (2) is turned on when the display panel is operated in the second stage II. When the second switch set (2) is turned on, the positive charges are transmitted to the first charge storage unit Cp, so that the voltage of the first charge storage unit Cp is equal to a positive common voltage Vp-com. In addition, the negative charges are transmitted to the second charge storage unit Cn, so that the voltage of the second charge storage unit Cn is equal to a negative common voltage Vn-com.

In other words, when the second switch set (2) is turned on, the data lines with the positive charges or the positive driving voltages (e.g. the odd-numbered data lines) are conducted, so that the positive charges are stored in the first charge storage unit Cp. In addition, the data lines with the negative charges or the negative driving voltages (e.g. the even-numbered data lines) are conducted, so that the negative charges are stored in the second charge storage unit Cn.

The third switch set (3) is turned on when the display panel is operated in the third stage III. Consequently, the charges distributed on all data lines are transmitted to the ground voltage in order to share charges.

The fourth switch set (4) is turned on when the display panel is operated in the fourth stage IV. When the fourth switch set (4) is turned on, the first charge storage unit Cp with the positive common voltage Vp-com, which is acquired in the second stage II, is in communication with the even-numbered data lines. Consequently, the positive charges are re-distributed to the even-numbered data lines. In addition, the second charge storage unit Cn with the negative common voltage Vn-com, which is acquired in the second stage II, is in communication with the odd-numbered data lines. Consequently, the negative charges are re-distributed to the odd-numbered data lines.

Afterwards, the first switch set (1) is turned on in the fifth stage V again. The relationships between the data lines and the voltage driving units in the fifth stage V are different from the ones in the first stage I. However, the circuitry arrangement is configured to provide driving voltages from the voltage driving units to corresponding data lines in order to display images.

Moreover, even if the driving voltages provided by the same driving unit have the same polarity during the first period (i.e. before the polarity inversion) and during the second period (i.e. after the polarity inversion), the magnitudes of the driving voltages may be different.

For example, when the first switch set (1) is turned on in the first stage I, the first voltage driving unit 211 provides a first positive driving voltage. When the first switch set (1) is turned on in the fifth stage V, the first voltage driving unit 211 provides a second positive driving voltage. Similarly, when the first switch set (1) is turned on in the first stage I, the second voltage driving unit 212 provides a first negative driving voltage. When the first switch set (1) is turned on in the fifth stage V, the second voltage driving unit 212 provides a second negative driving voltage.

For the odd-numbered data lines, since the negative charges are provided by the second charge storage unit Cn in the fourth stage IV, voltages of the odd-numbered data lines are not decreased from 0 volt in the fifth stage V. Instead, the voltages of the odd-numbered data lines are decreased from a pre-biased negative voltage (i.e. the negative common voltage Vn-com) to the voltages equal to driving voltages provided by the negative voltage driving units (e.g. the second voltage driving unit 212 and the fourth voltage driving unit 214).

For even-numbered data lines, since the positive charges are provided by the first charge storage unit Cp in the fourth stage IV, the voltages of the even-numbered data lines are not increased from 0 volt in the fifth stage V. Instead, the voltages of the even-numbered data lines are increased from a pre-biased positive voltage (i.e. the positive common voltage Vp-com) to the voltages equal to driving voltages which are provided by the positive voltage driving units (e.g. the first voltage driving unit 211 and the third voltage driving unit 213).

Figure 2A:
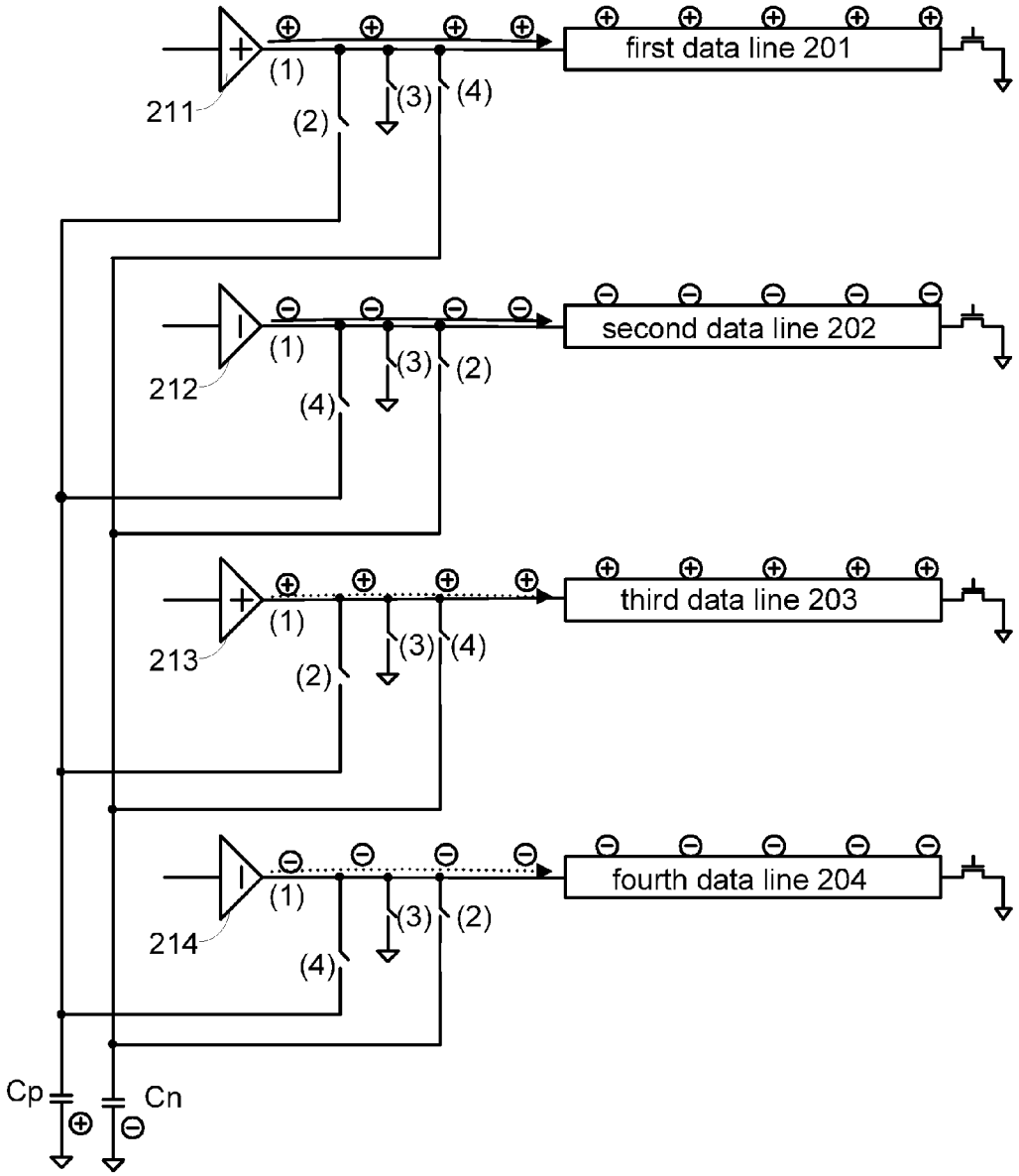
FIG. 2A is a schematic circuit diagram illustrating the first stage of the charge-sharing control method according to an embodiment of the present invention, in which the positive driving voltage and the negative driving voltage applied to the data lines.
Figure 2B:
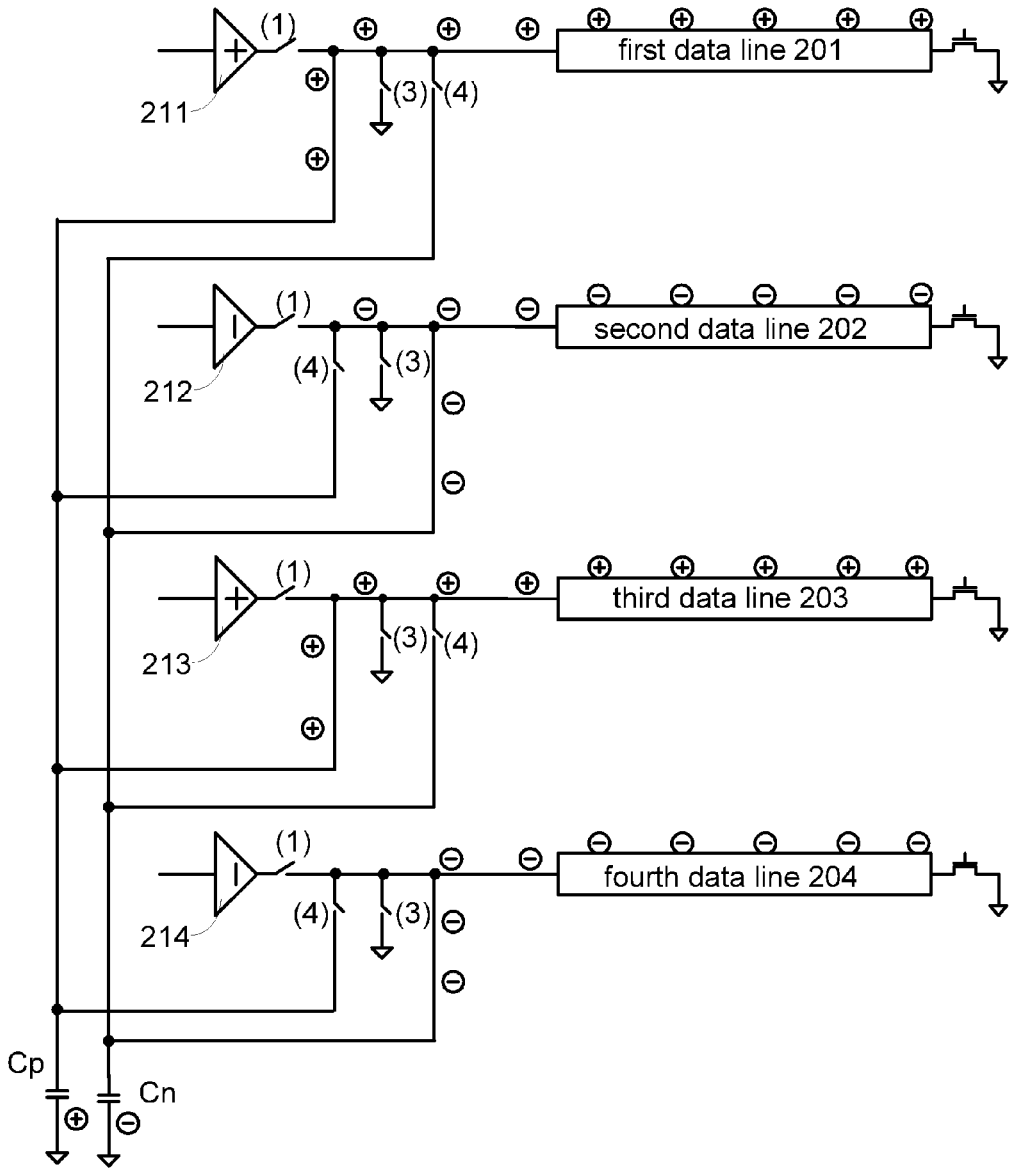
FIG. 2B is a schematic circuit diagram illustrating the second stage of the charge-sharing control method according to an embodiment of the present invention, in which charges are stored into the charge storage units.
Figure 2C:
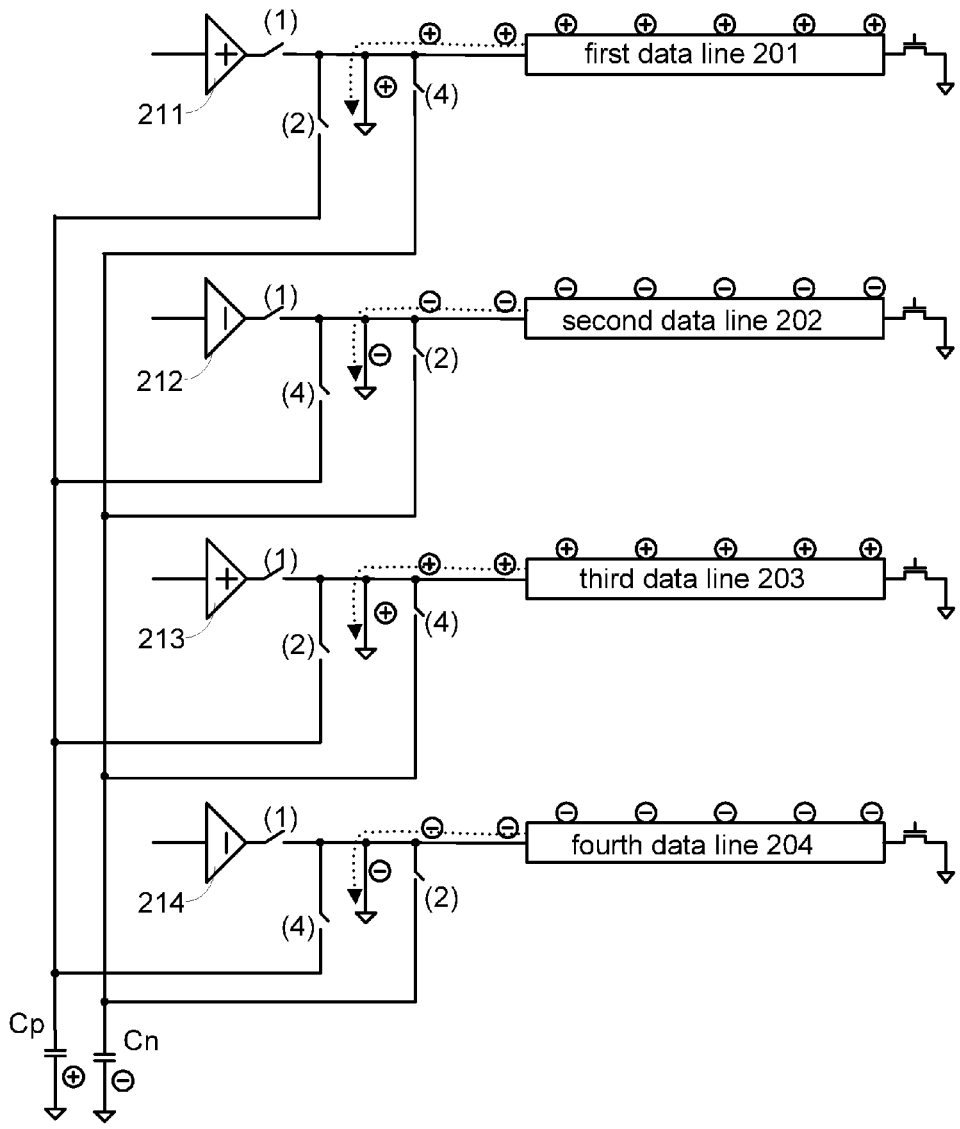
FIG. 2C is a schematic circuit diagram illustrating the third stage of the charge-sharing control method according to an embodiment of the present invention, in which the data lines are all electrically connected with the ground voltage.
Figure 2D:
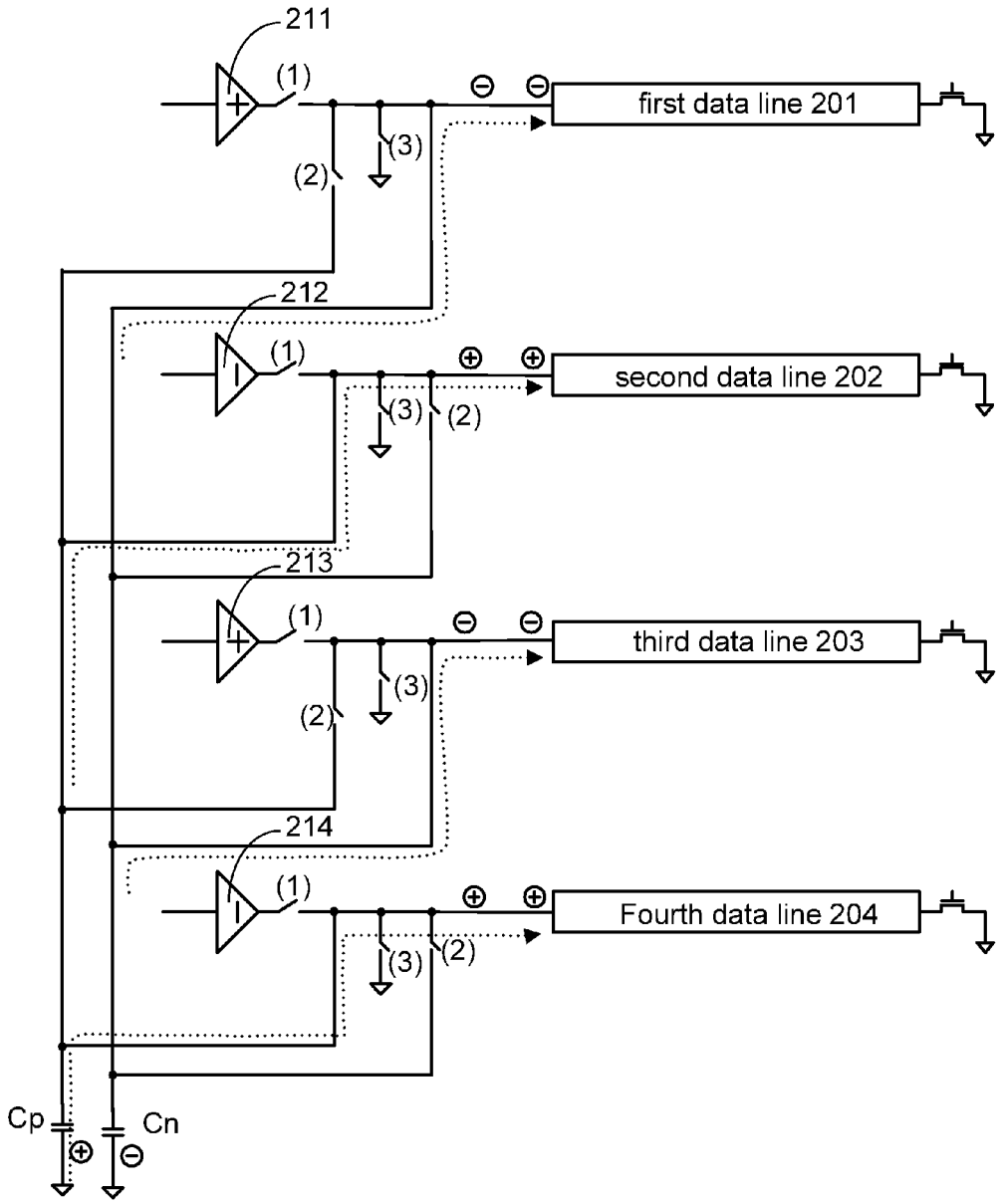
FIG. 2D is a schematic circuit diagram illustrating the fourth stage of the charge-sharing control method according to an embodiment of the present invention, in which charges are re-distributed to the data lines after the polarity inversion.
Figure 2E:
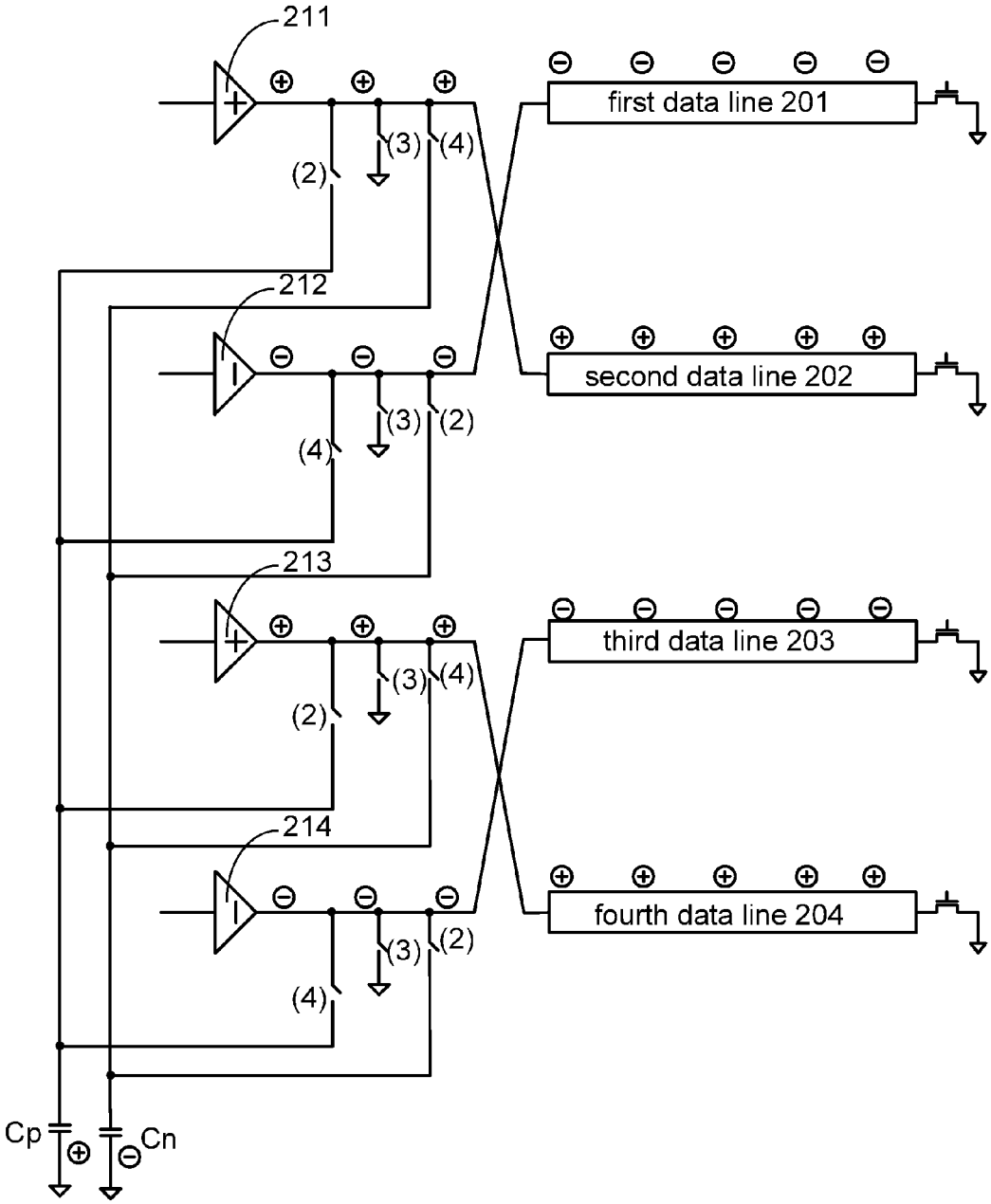
FIG. 2E is a schematic circuit diagram illustrating the fifth stage of the charge-sharing control method according to an embodiment of the present invention, in which the polarity inversion is completed.
Figure 2F:
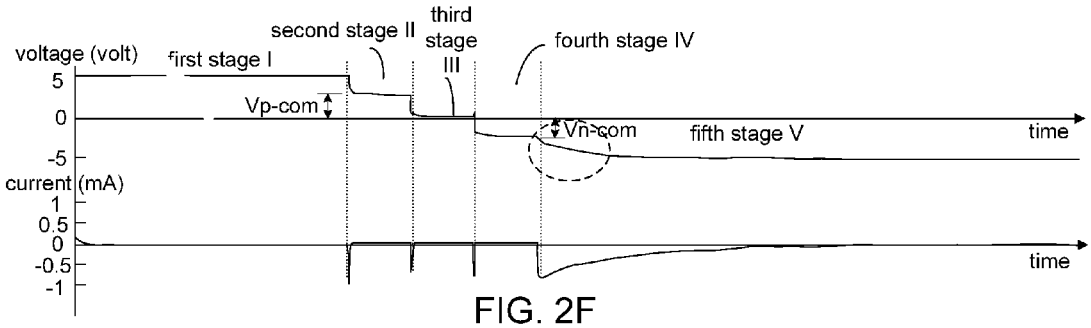
FIG. 2F is a schematic timing waveform diagram illustrating associated voltages applied to the first data line of the control circuit of FIGS. 2A-2E in different stages.

FIG. 2F is a schematic timing waveform diagram illustrating associated voltages applied to the first data line of the control circuit of FIGS. 2A~2E in different stages.

Figure 2G:
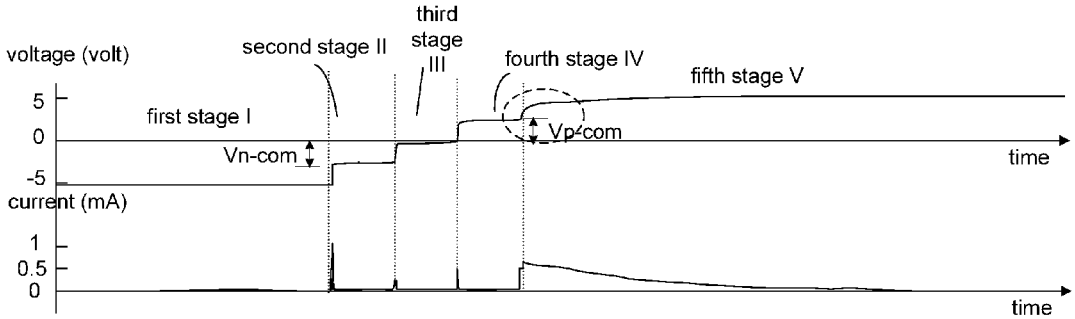
FIG. 2G is a schematic timing waveform diagram illustrating associated voltages applied to the second data line of the control circuit of FIGS. 2A~2E in different stages.

FIG. 2G is a schematic timing waveform diagram illustrating associated voltages applied to the second data line of the control circuit of FIGS. 2A~2E in different stages.

The voltages applied to the third data line 203 and the fourth data line 204 in different stages are respectively similar to those applied to the first data line 201 and the second data line 202, and are not redundantly described herein. Hereinafter, the operations of the control circuit will be illustrated with reference to FIGS. 2A~2E and FIGS. 2F~2G.

FIG. 2A is a schematic circuit diagram illustrating the first stage of the charge-sharing control method according to an embodiment of the present invention, in which the positive driving voltage and the negative driving voltage applied to the data lines. When the first switch set (1) is turned on in the first stage I, the data lines are electrically connected with corresponding voltage driving units which provides the positive driving voltages and the negative driving voltages. Consequently, all of the data lines are maintained at constant voltages.

That is, the first data line 201 is electrically connected with the first voltage driving unit 211, so that the voltage of the first data line 201 is maintained at a first positive driving voltage (e.g. +5 volt). The second data line 202 is electrically connected with the second voltage driving unit 212, so that the voltage of the second data line 202 is maintained at a first negative driving voltage (e.g. −5 volt).

Similarly, the third data line 203 is electrically connected with the third voltage driving unit 213, so that the voltage of the third data line 203 is maintained at another positive driving voltage. Similarly, the fourth data line 304 is electrically connected with the fourth voltage driving unit 214, so that the voltage of the fourth data line 304 is maintained at another negative driving voltage. As shown in FIGS. 2F and 2G, in the stage I, the voltage of the first data line 201 is about +5 volt, and the voltage of the second data line 202 is about −5 volt.

FIG. 2B is a schematic circuit diagram illustrating the second stage of the charge-sharing control method according to an embodiment of the present invention, in which charges are stored into the charge storage units. In the second stage II, the second switch set (2) is turned on, so that the first data line 201 is electrically connected with the first charge storage unit Cp. Under this circumstance, the positive charges are transmitted to the first charge storage unit Cp, so that the voltage of the first charge storage unit Cp is maintained at the positive common voltage Vp-com. As shown in FIG. 2F, the voltage of the first data line 201 in the second stage II is about +2.5 volts.

On the other hand, since the second switch set (2) is turned on, the second data line 202 is electrically connected with the second charge storage unit Cn. Under this circumstance, the negative charges are transmitted to the second charge storage unit Cn, so that the voltage of the second charge storage unit Cn is maintained at the negative common voltage Vn-com. As shown in FIG. 2G, the voltage of the second data line 202 in the second stage II is about −2.5 volts.

FIG. 2C is a schematic circuit diagram illustrating the third stage of the charge-sharing control method according to an embodiment of the present invention, in which the data lines are all connected with the ground voltage. Since the first data line 201 and the second data line 202 are electrically connected with the ground voltages in the third stage III, the voltages of the first data line 201 and the second data line 202 are maintained at about 0 volt (see FIGS. 2F and 2G).

FIG. 2D is a schematic circuit diagram illustrating the fourth stage of the charge-sharing control method according to an embodiment of the present invention, in which charges are re-distributed to the data lines after the polarity inversion. Since the fourth switch set (4) is turned on, the odd-numbered data lines are electrically connected with the second charge storage unit Cn, which stores negative charges. In addition, the even-numbered data lines are electrically connected with the first charge storage unit Cp, which stores positive charges.

As shown in FIG. 2F, since the negative charges provided by the second charge storage unit Cn are transmitted to the first data line 201 in the fourth stage IV, the voltage of the first data line 201 is decreased from 0 volt to about −2.5 volts (i.e. the negative common voltage Vn-com). It means that the first data line 201 is discharged by the second charge storage unit Cn.

As shown in FIG. 2G, since the positive charges provided by the first charge storage unit Cp are transmitted to the first data line 201 in the fourth stage IV, the voltage of the second data line 202 is increased from 0 volt to about +2.5 volts (i.e. the positive common voltage Vp-com). It means that the second data line 201 is charged by the first charge storage unit Cp.

FIG. 2E is a schematic circuit diagram illustrating the fifth stage of the charge-sharing control method according to an embodiment of the present invention, in which the polarity inversion is completed. Take a dot inversion for example. The polarity inversion is performed when the driving voltages applied to the next row of pixels are refreshed. The relationships between the data lines and the voltage driving units during the second period are different from the relationships between the data lines and the voltage driving units during the first time period. Under this circumstance, the data lines and the voltage driving units are connected with each other in a staggered arrangement.

For example, when the first switch set (1) is turned on in the first stage I, the first data line 201 and the second data line 202 are respectively and electrically connected with the first voltage driving unit 211 and the second voltage driving unit 212. Whereas, in the fifth stage V, the first data line 201 and the second data line 202 are respectively and electrically connected with the second voltage driving unit 212 and the first voltage driving unit 211. Similarly, in the fifth stage V, the third data line 203 and the fourth data line 204 are respectively and electrically connected with the fourth voltage driving unit 214 and the third voltage driving unit 213.

As shown in FIGS. 2E and 2F, since the first data line 201 is electrically connected with the second voltage driving unit 212 through the first switch set (1), the voltage of the first data line 201 is changed from the negative common voltage Vn-com (−2.5 volts) to the second negative driving voltage (−5 volts). As shown in FIGS. 2E and 2G, since the second data line 202 is electrically connected with the first voltage driving unit 211 through the first switch set (1), the voltage of the second data line 202 is changed from the positive common voltage Vp-com (+2.5 volts) to the second positive driving voltage (+5 volts).

From the above discussions, the positive and negative charges that are possibly lost are firstly stored in the charge storage units in the second stage II, and will be reused in the fourth stage IV. By the charge-sharing control method, the range of the voltage change of the data lines in the fifth stage V will be reduced. That is, for each data line, a capacitor is employed to store charges. Since the charges may be reused during the polarity inversion, the power consumption of the display panel is reduced.

Although the charge-sharing control method as described in FIGS. 2A~2G is effective to reduce the power consumption, the charge-sharing control method needs to be further improved. For example, after the polarity inversion is performed, the second positive driving voltage is possibly lower than the positive common voltage Vp-com, and the second negative driving voltage is possibly higher than the negative common voltage Vn-com. That is, the driving voltages provided to the data lines are not always changed between +5 volts and −5 volts at each time. Once the range of the voltage change is reduced, the charge-sharing control method of FIG. 2 may result in an over-charging problem or an over-discharging problem.

For example, in the fifth stage V, the second negative driving voltage provided by the second voltage driving unit 212 is possibly −0.2 volt. If the negative common voltage Vn-com stored in the second charge storage unit Cn in the fourth stage IV is −2.5 volts, the first data line 201 needs to be charged in this situation. Consequently, the voltage of the first data line 201 is increased from the negative common voltage Vn-com (−2.5 volts) to the second negative driving voltage (−0.2 volt).

That is, the second negative driving voltage is not always lower than the negative common voltage Vn-com. Due to the negative common voltage Vn-com in the fourth stage IV, the first data line 201 needs to be charged in the fifth stage V. The repeat charging and discharging actions may consume additional time and addition electric energy.

Similarly, in the fifth stage V, the second positive driving voltage provided by the first voltage driving unit 211 is possibly +0.2 volt. If the positive common voltage Vp-com stored in the first charge storage unit Cp in the fourth stage IV is +2.5 volts, the second data line 202 needs to be discharged in this situation. Consequently, the voltage of the second data line 202 is decreased from the positive common voltage Vp-com (+2.5 volts) to the second positive driving voltage (+0.2 volt).

That is, the second positive driving voltage is not always higher than the positive common voltage Vp-com. Due to the positive common voltage Vp-com in the fourth stage IV, the second data line 202 needs to be discharged in the fifth stage V. The repeat charging and discharging actions may consume additional time and addition electric energy.

In FIGS. 2F and 2G, the regions circumscribed by dashed lines indicate the voltage changes of the first data line 201 and the second data line 202 from the fourth stage IV to the fifth stage V.

For preventing from over-discharging the first data line 201 in the fourth stage IV and over-charging the second data line 202 in the fourth stage IV, the present invention further provides a method for judging whether the charge storage units need to pre-charge or pre-discharge the first and the second data lines before the charging/discharging action in the fourth stage IV according to the driving voltages in the fifth stage V.

That is, the charge-sharing control method of the present invention may determine whether the first charge storage unit Cp and the second charge storage unit Cn are employed to charge and discharge the data lines according to the driving voltages provided by the voltage driving units and the voltages of the data lines. If the driving voltage fails to enable the comparison circuit, i.e. the second positive driving voltage or the second negative driving voltage is close to the ground voltage, the first charge storage unit Cp or the second charge storage unit Cn is not employed to charge or discharge the data line.

Figure 3A:
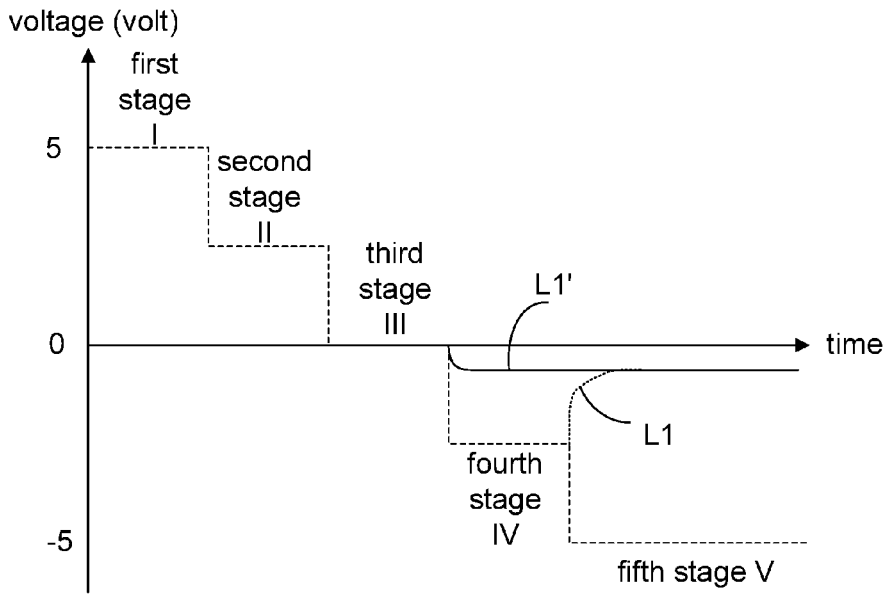
FIG. 3A is a schematic timing waveform diagram illustrating the voltage change of the first data line, in which the first data line is discharged by the second negative driving voltage from the second voltage driving unit according to the data voltage judgment.

Hereinafter, a method of selectively performing a charging action or a discharging action according to the level of the driving voltage provided by the voltage driving unit will be illustrated with reference to FIGS. 3A~3D. FIG. 3A is a schematic timing waveform diagram illustrating the voltage change of the first data line, in which the first data line is discharged by the second negative driving voltage from the second voltage driving unit according to the voltage of the first data line. In FIG. 3A, the stepwise-declined dotted lines indicate an ideal voltage change curve of the charge-sharing control method of the present invention.

As mentioned above, after the charge-sharing action is performed in the fourth stage IV and the display panel is operated in the fifth stage V, if the absolute value of the second negative driving voltage (e.g. −0.6 volt) provided by the second voltage driving unit 312 is lower than the absolute value of the negative common voltage Vn-com, the voltage of the first data line 301 in the fifth stage V is denoted by the curve L1. Consequently, the voltage driving unit should be re-employed to increase the voltage of the first data line 301 from the negative common voltage Vn-com (−2.5 volts) to the second negative driving voltage (−0.6 volt).

For solving the above drawbacks, the charge-sharing control method of the present invention may directly discharge the voltage of the first data line 301 to the required driving voltage by the voltage driving unit in the fourth stage IV. As shown in FIG. 3A, the voltage of the first data line 301 is discharged from 0 volt to −0.6 volt in the fourth stage IV along the curve L1'.

That is, if the second negative driving voltage is relatively close to the ground voltage, the first data line 301 is no longer charged by the second charge storage unit Cn, but maintained at 0 volt in the fourth stage IV. That is, the voltage of the first data line 301 is not changed from the ground voltage (0 volt) to the negative common voltage Vn-com. Instead, the voltage of the first data line 301 is directly decreased from 0 volt to the second negative driving voltage. Consequently, the power waste from the action of repeatedly charging and discharging the first data line 301 will be minimized.

Figure 3B:
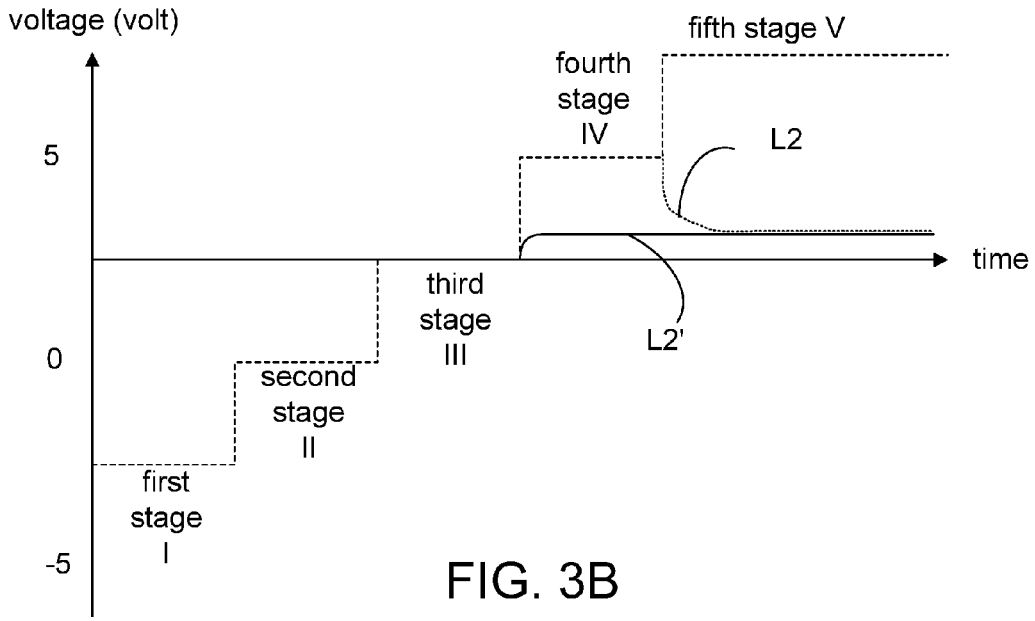
FIG. 3B is a schematic timing waveform diagram illustrating the voltage change of the second data line, in which the second data line is charged by the second positive driving voltage from the first voltage driving unit according to the data voltage judgment.

FIG. 3B is a schematic timing waveform diagram illustrating the voltage change of the second data line, in which the second data line is charged by the second positive driving voltage from the first voltage driving unit according to the voltage of the second data line. In FIG. 3B, the stepwise-declined dotted lines indicate an ideal voltage change curve of the charge-sharing control method of the present invention.

As mentioned above, after the charge-sharing action is performed in the fourth stage IV and the display panel is operated in the fifth stage V, if the absolute value of the second positive driving voltage (e.g. +0.6 volt) provided by the first voltage driving unit 311 is lower than the absolute value of the positive common voltage Vp-com, the voltage of the second data line 302 in the fifth stage V is denoted by the curve L2. Consequently, the voltage driving unit should be re-employed to decrease the voltage of the second data line 301 from the positive common voltage Vp-com (+2.5 volts) to the second positive driving voltage (+0.6 volt).

For solving the above drawbacks, the charge-sharing control method of the present invention may directly charge the voltage of the second data line 302 to the second positive driving voltage from the ground voltage (0 volt) in the fourth stage IV. As shown in FIG. 3B, the voltage of the second data line 302 is charged from 0 volt to +0.6 volt in the fourth stage IV along the curve L2'.

That is, if the second positive driving voltage is relatively close to the ground voltage, the second data line 302 is no longer charged by the first charge storage unit Cp, but maintained at 0 volt in the fourth stage IV. That is, the voltage of the first data line 301 is not changed from the ground voltage (0 volt) to the positive common voltage Vp-com. Instead, the voltage of the second data line 302 is directly increased from 0 volt to the second positive driving voltage. Consequently, the power waste from the action of repeatedly charging and discharging the second data line 302 will be minimized.

Hereinafter, some embodiments of selectively utilizing the charge storage unit to perform a discharging action, a charging action or no action on the data line according to the magnitude of the driving voltage will be illustrated in more details.

Figure 3C:
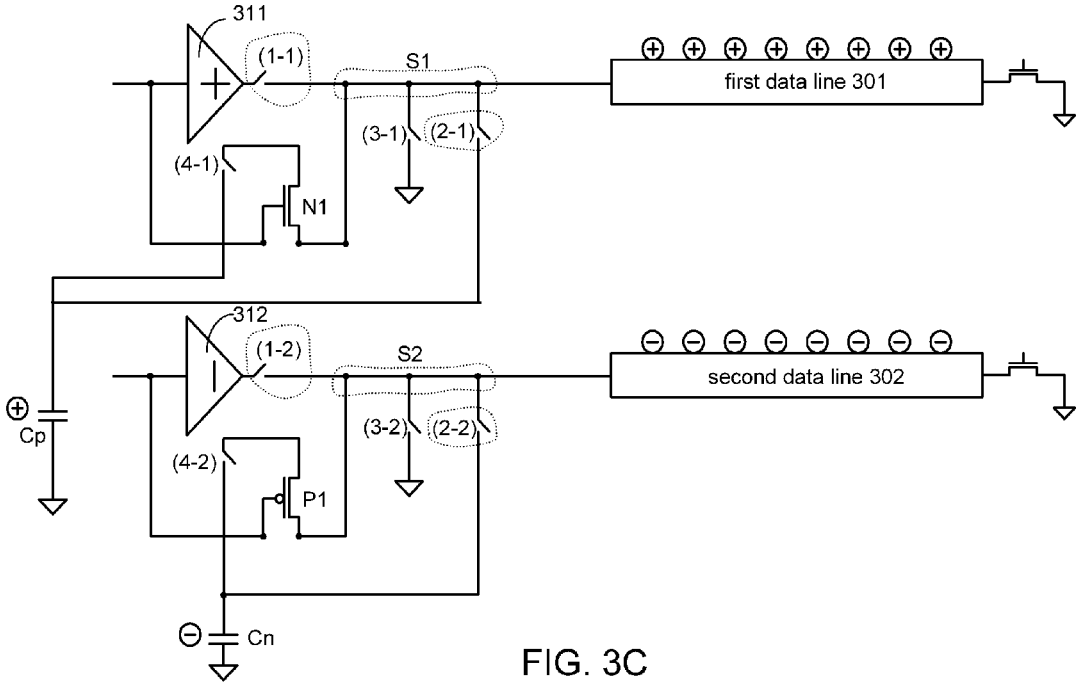
FIG. 3C is a schematic circuit diagram illustrating a way of sharing charges by using a control device with a NMOS transistor, a PMOS transistor and charge storage units before the polarity inversion is performed.
Figure 3D:
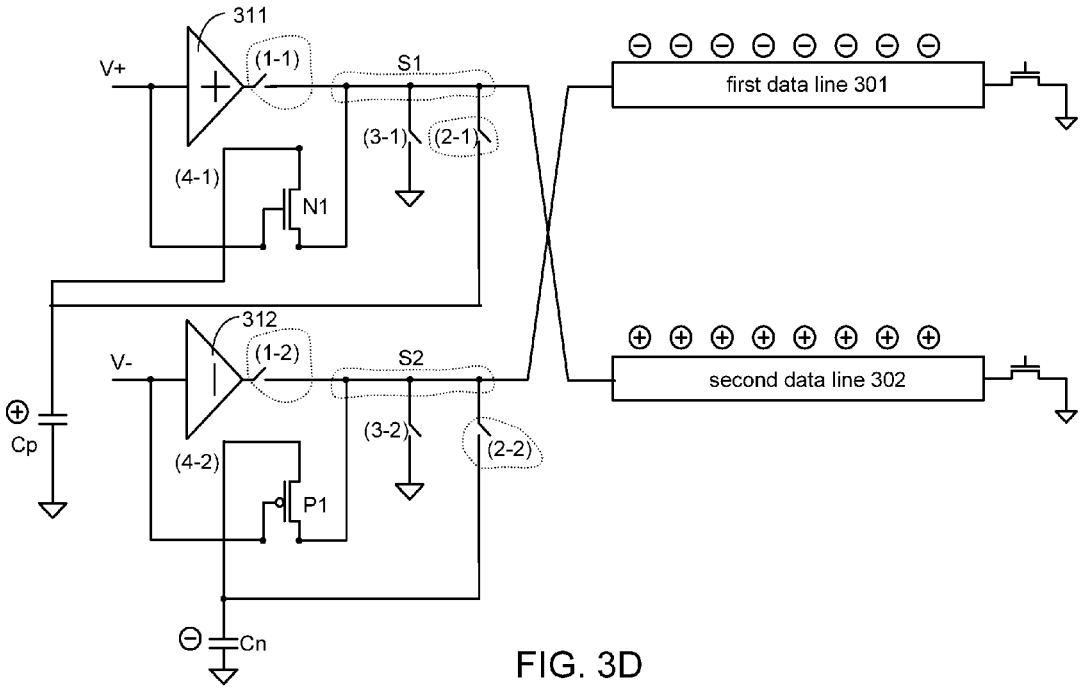
FIG. 3D is a schematic circuit diagram illustrating a way of sharing charges by using a control device with a NMOS transistor, a PMOS transistor and charge storage units after the polarity inversion is performed.

In an embodiment as shown in FIGS. 3C and 3D, an exemplary control device of a display panel includes a plurality of data lines, plural voltage driving units, plural charge storage units, and a plurality of switch sets. The control device further includes a plurality of NMOS transistors and a plurality of PMOS transistors.

For clarification and brevity, only two data lines of the control device will be illustrated in the drawings. That is, only the first data line 301 and the second data line 302 of the plurality of data lines will be discussed. That is, only the relationships between the first voltage driving unit 311 and the second voltage driving unit 312 of the plurality of voltage driving units and the plurality of switch sets, the arrangements of the switch sets between the data lines and the voltage driving units and the relationships between plurality of NMOS transistors and the plurality of PMOS transistors between the first data line 301 and the second data line 302 will be illustrated. The relationships between other data lines and corresponding voltage driving units are similar. Moreover, the number of the charge storage units of the control device may be varied according to the practical requirements.

Hereinafter, a method of selectively performing a charging action or a discharging action according to the level of the driving voltage provided by the voltage driving unit will be illustrated with reference to FIGS. 3C and 3D. FIG. 3C is a schematic circuit diagram illustrating a way of sharing charges by using a control device with a NMOS transistor, a PMOS transistor and charge storage units before the polarity inversion is performed. FIG. 3D is a schematic circuit diagram illustrating a way of sharing charges by using a control device with a NMOS transistor, a PMOS transistor and charge storage units after the polarity inversion is performed.

The switch sets of the control device may be controlled in response to timing control signals sent from the timing controller (not shown). In this embodiment, the first period before the polarity inversion includes the first stage I, the second stage II and the third stage III, and the second period after the polarity inversion includes the fourth stage IV and the fifth stage V. In response to the timing control signals, the first switch set (1) is turned on in the first stage I and the fifth stage V. In response to the timing control signal, the second switch set (2), the third switch set (3) and the fourth switch set (4) are turned on in the second stage II, the third stage III and the fourth stage IV, respectively.

The first switch set (1) is arranged between these voltage driving units and corresponding data lines. The second switch set (2) is arranged between these charge storage units and corresponding data lines. The third switch set (3) is arranged between these data lines and the ground voltage. For facilitating illustration, each of the switch sets includes a first sub-switch and a second sub-switch.

The first sub-switch (1-1) of the first switch set (1), the first sub-switch (2-1) of the second switch set (2) and the first sub-switch (3-1) of the third switch set (3) are electrically connected with a first node S1. The second sub-switch (1-2) of the first switch set (1), the second sub-switch (2-2) of the second switch set (2) and the second sub-switch (3-2) of the third switch set (3) are electrically connected with a second node S2.

When the first sub-switch (1-1) and the second sub-switch (1-2) of the first switch set (1) are turned on in the first stage I, the first voltage driving unit 311 provides the first positive driving voltage to the first data line 301 through the first node S1, and the second voltage driving unit 312 provides the first negative driving voltage to the second data line 302 through the second node S2.

When the first sub-switch (2-1) and the second sub-switch (2-2) of the second switch set (2) are turned on the second stage II, the first data line 301 with the first positive driving voltage may transmit the positive charges to the first charge storage unit Cp through the first sub-switch (2-1) of the second switch set (2), and the second data line 302 with the first negative driving voltage may transmit the negative charges to the second charge storage unit Cn through the second sub-switch (2-2) of the second switch set (2). Under this circumstance, the first charge storage unit is with the positive common voltage Vp-com, and the second charge storage unit Cn is with the negative common voltage Vn-com.

In the third stage III, when the first sub-switch (3-1) and the second sub-switch (3-2) of the third switch set (3) are turned on, the first data line 301 and the second data line 302 are electrically connected with the ground voltage. Consequently, the voltages of the first data line 301 and the second data line 302 are both 0 volt in the third stage III.

During the first time period, connections between the voltage driving units, the ground voltage, and the charge storage units via the first switch set (1), the second switch set (2) and the third switch set (3) are similar to those described in FIGS. 2A~2C. Therefore, the voltage changes of the corresponding data lines are also similar and not redundantly described. Hereinafter, only the operating statuses of the control device before and after the polarity inversion will be illustrated with reference to FIGS. 3C and 3D.

Please refer to FIG. 3C again. The control device further includes a first comparison circuit and a second comparison circuit. The first comparison circuit includes a first comparison switch (4-1) and the NMOS transistor N1. The second comparison circuit includes a second comparison switch (4-2) and the PMOS transistor P1.

After the polarity inversion is performed, the first comparison circuit is employed to determine whether the second data line 302 is charged by the positive common voltage Vp-com, and the second comparison circuit is employed to determine whether the first data line 301 is discharged by the negative common voltage Vn-com.

Before the polarity inversion is performed, the first comparison switch (4-1) is not electrically connected between the first charge storage unit Cp and the NMOS transistor N1, and the second comparison switch (4-2) is not electrically connected between the second charge storage unit Cn and the PMOS transistor P1.

The gate terminal of the NMOS transistor N1 is electrically connected with the first voltage driving unit 311. The drain terminal of the NMOS transistor N1 is electrically connected with the first comparison switch (4-1). The source terminal of the NMOS transistor N1 is electrically connected with the first data line 301 or the second data line 302 through the first node S1. Before the polarity inversion is performed, the first node S1 is electrically connected with the first data line 301. After the polarity inversion is performed, the first node S1 is electrically connected with the second data line 302.

The gate terminal of the PMOS transistor P1 is electrically connected with the second voltage driving unit 312. The drain terminal of the PMOS transistor P1 is electrically connected with the second comparison switch (4-2). The source terminal of the PMOS transistor P1 is electrically connected with the first data line 301 or the second data line 302 through the second node S2. Before the polarity inversion is performed, the second node S2 is electrically connected with the second data line 302. After the polarity inversion is performed, the second node S2 is electrically connected with the first data line 301.

Please refer to FIG. 3D again. After the polarity inversion is performed, the first comparison switch (4-1) and the second comparison switch (4-2) are both turned on in the fourth stage IV. The operations of the NMOS transistor N1 and the PMOS transistor P1 will be illustrated as follows.

The gate terminal of the NMOS transistor N1 is electrically connected with the first voltage driving unit 311. When the first comparison switch (4-1) is turned on, the drain terminal of the NMOS transistor N1 will be electrically connected with the first charge storage unit Cp. Before the polarity inversion is performed, the source terminal of the NMOS transistor N1 is electrically connected with the first data line 301 through the first node S1. After the polarity inversion is performed, source terminal of the NMOS transistor N1 is electrically connected with the second data line 302 through the first node S1.

In this embodiment, the on/off states of the NMOS transistor N1 are determined according to a voltage difference between the gate terminal and the source terminal of the NMOS transistor N1. That is, the on/off states of the NMOS transistor N1 are determined according to a voltage difference between the second positive driving voltage from the first voltage driving unit 311 and the voltage of the second data line 302.

If the second positive driving voltage is higher than the voltage of the second data line 302 by at least a first threshold voltage, the NMOS transistor N1 is turned on. Under this circumstance, the second data line 302 is charged by the first charge storage unit Cp. Consequently, the voltage of the second data line 302 is increased from 0 volt to the positive common voltage Vp-com. Then, the second data line 302 is charged by the first voltage driving unit 311, so that the voltage of the second data line 302 is increased from the positive common voltage Vp-com to the second positive driving voltage.

On the other hand, if the second positive driving voltage is not higher than the voltage of the second data line 302 by at least the first threshold voltage, the NMOS transistor N1 is turned off. Consequently, the second data line 302 is not charged by the first charge storage unit Cp. Meanwhile, the second data line 302 may be directly charged by the second positive driving voltage from the first voltage driving unit 311.

For example, it is assumed that the positive common voltage Vp-com is +2.5 volts and the negative common voltage Vn-com is −2.5. In a case that the second positive driving voltage is +4.5 volt, the gate terminal of the NMOS transistor N1 electrically connected with the first voltage driving unit 311 is also +4.5 volt. Since the source terminal of the NMOS transistor N1 is electrically connected with the second data line 302, the voltage of the source terminal of the NMOS transistor N1 is 0 volt.

Since the voltage difference Vgs between the gate terminal and the source terminal of the NMOS transistor N1 (4.5 volt−0 volt=4.5 volt) is higher than a critical voltage (e.g. 0.7 volt), the NMOS transistor N1 is turned on. Under this circumstance, the voltage of the second data line 302 connected with the source terminal of the NMOS transistor N1 will be increased from 0 volt to the positive common voltage Vp-com (e.g. +2.5 volts). When the first switch set (1) is turned on, the second data line 302 is charged by the first voltage driving unit 311, so that the voltage of the second data line 302 is increased from +2.5 volts to +4.5 volts.

On the other hand, in a case that the second positive driving voltage is +0.5 volt, the gate terminal of the NMOS transistor N1 electrically connected with the first voltage driving unit 311 is also +0.5 volt. Since the source terminal of the NMOS transistor N1 is electrically connected with the second data line 302, the voltage of the source terminal of the NMOS transistor N1 is 0 volt.

Since the voltage difference Vgs between the gate terminal and the source terminal of the NMOS transistor N1 (0.5 volt−0 volt=0.5 volt) is lower than the critical voltage, the first charge storage unit Cp is not electrically connected with the second data line 302 through the NMOS transistor N1. Meanwhile, the voltage of the second data line 302 is not influenced by the positive common voltage Vp-com. Until the first switch set (1) is turned on, the second data line 302 is directly charged by the first voltage driving unit 311 to be increased to the second positive driving voltage (+0.5 volt).

The processes of determining the on/off states of the PMOS transistor P1 are similar to those of the NMOS transistor N1, and are not redundantly described herein.

From the above discussions, when the first comparison switch (4-1) is turned on, the voltage of the first charge storage unit Cp is conducted to the drain terminal of the NMOS transistor N1 through the first comparison switch (4-1). Meanwhile, if the first comparison switch (4-1) is turned on and a first comparison result is complied, the positive common voltage Vp-com is conducted to the first node S1 to charge the second data line 302.

When the second comparison switch (4-2) is turned on, the voltage of the second charge storage unit Cn is conducted to the drain terminal of the PMOS transistor P1 through the second comparison switch (4-2). Meanwhile, if the second comparison switch (4-2) is turned on and a second comparison result is complied, the negative common voltage Vn-com is conducted to the second node S2 to discharge the first data line 301.

When the NMOS transistor N1 is turned on, it means that the second positive driving voltage is higher than the voltage of the second data line 302 and the voltage difference between the second positive driving voltage and the voltage of the second data line 302 is higher than the critical voltage (i.e. the first threshold voltage) of the NMOS transistor N1. Consequently, a first charging action of charging the second data line 302 by the positive common voltage Vp-com is performed, and a second charging action of charging the second data line 302 by the first voltage driving unit 311 is performed. In such way, the voltage of the second data line 302 is increased from the positive common voltage Vp-com to the second positive driving voltage. On the other hand, if the NMOS transistor N1 is not turned on, the second data line 302 with the ground voltage is directly charged to the second positive driving voltage by the first voltage driving unit 311.

When the PMOS transistor P1 is turned on, it means that the second negative driving voltage is lower than the voltage of the first data line 301 and the voltage difference between the second negative driving voltage and the voltage of the first data line 301 is higher than the critical voltage (i.e. a second threshold voltage) of the PMOS transistor P1. Consequently, a first discharging action of discharging the first data line 301 by the negative common voltage Vn-com is performed, and a second discharging action of discharging the first data line 301 by the second voltage driving unit 312 is performed. In such way, the voltage of the first data line 301 is decreased from the negative common voltage Vn-com to the second negative driving voltage. On the other hand, if the PMOS transistor P1 is not turned on, the second data line 302 with the ground voltage is directly discharged to the second negative driving voltage by the second voltage driving unit 312.

From the above discussions, the second date line 302 is not always charged by the first charge storage unit Cp after the polarity inversion is performed. Only when the comparison between the second positive driving voltage and the voltage of the second data line 302 complies with the first comparing result, the positive common voltage Vp-com is conducted to the first node S1 through the on-state NMOS transistor N1. Consequently, the second data line 302 is charged by the positive common voltage Vp-com.

In this context, if the second positive driving voltage is higher than the voltage of the second data line 302 by at least the first threshold voltage, the comparison between the second positive driving voltage and the voltage of the second data line 302 complies the first comparison result. Under this circumstance, the voltage difference between the gate terminal and the source terminal of the NMOS transistor N1 is higher than the critical voltage of the NMOS transistor N1.

That is, according to the first comparison result, the second data line 302 is charged from the ground voltage (0 volt) to the positive common voltage Vp-com by the first charge storage unit Cp and then charged from the positive common voltage Vp-com to the second positive driving voltage, or the second data line 302 is directly charged from the ground voltage (0 volt) to the second positive driving voltage by the first voltage driving unit 311.

Similarly, the first date line 301 is not always discharged by the negative common voltage Vn-com after the polarity inversion is performed. Only when the comparison between the second negative driving voltage and the voltage of the first data line 301 complies with the second comparison result, the negative common voltage Vn-com is transmitted to the second node S2 through the on-state PMOS transistor P1. Consequently, the first data line 301 is discharged by the negative common voltage Vn-com.

In this context, if the second negative driving voltage is lower than the voltage of the first data line 301 by at least the second threshold voltage, the comparison between the second negative driving voltage and the voltage of the first data line 301 complies with the second comparison result. Under this circumstance, the voltage difference between the gate terminal and the source terminal of the PMOS transistor P1 is higher than the critical voltage of the PMOS transistor P1.

That is, according to the second comparison result, the first data line 301 is discharged from the ground voltage to the negative common voltage Vn-com and then discharged from the negative common voltage Vn-com to the second negative driving voltage, or the first data line 301 is directly discharged from the ground voltage to the second negative driving voltage by the second voltage driving unit 312.

From the above discussions, the on/off states of the NMOS transistor N1 is determined according to the magnitudes of the second positive driving voltage and the voltage of the second data line 302. In other words, the second data line 302 will be charged when the first comparison switch (4-1) is turned on and the NMOS transistor N1 is turned on.

On the other hand, the on/off states of the PMOS transistor P1 is determined according to the magnitudes of the second negative driving voltage and the voltage of the first data line 301. In other words, the first data line 301 will be discharged once the second comparison switch (4-2) is turned on and the PMOS transistor P1 is turned on.

In other words, the NMOS transistor N1 and the PMOS transistor P1 may be considered as the auxiliary switches of the first comparison switch (4-1) and the second comparison switch (4-2). If the first comparison result is complied, the NMOS transistor N1 is turned on. Whereas, if the second comparison result is complied, the PMOS transistor P1 is turned on.

From the above discussions about the control device of FIGS. 3C and 3D, the controlling method of the present invention includes the following steps.

Firstly, the first switch set (1-1, 1-2) is turned on in the first stage I, the first voltage driving unit 311 provides a first positive driving voltage to the first data line 301, and the second voltage driving unit 312 provides a first negative driving voltage to the second data line 302.

Next, the second switch set (2-1, 2-2) is turned on in the second stage II. Consequently, the first data line 301 with the first positive driving voltage transmits the positive charges to the first charge storage unit Cp, and the second data line 302 with the first negative driving voltage transmits the negative charges to the second charge storage unit Cn. Next, the third switch set (3-1, 3-2) is turned on in the third stage III, so that the first data line 301 and the second data line 302 are both connected with the ground voltage.

After the polarity inversion is performed, if the comparison between the second positive driving voltage and the voltage of the second data line 302 complies with the first comparison result, a charging action of the second data line 302 is performed. Whereas, if the comparison between the second negative driving voltage and the voltage of the first data line 301 complies with the second comparison result, a discharging action of the first data line 301 is performed.

That is, according to the first comparison result, the second data line 302 is charged from the ground voltage to the positive common voltage Vp-com by the first charge storage unit Cp and then charged from the positive common voltage Vp-com to the second positive driving voltage, or the second data line 302 is directly charged from the ground voltage to the second positive driving voltage.

Moreover, according to the second comparison result, the first data line 301 is discharged from the ground voltage to the negative common voltage Vn-com of the second charge storage unit Cn and then discharged from the negative common voltage Vn-com to the second negative driving voltage, or the first data line 301 is directly discharged from the ground voltage to the second negative driving voltage.

Figure 4:
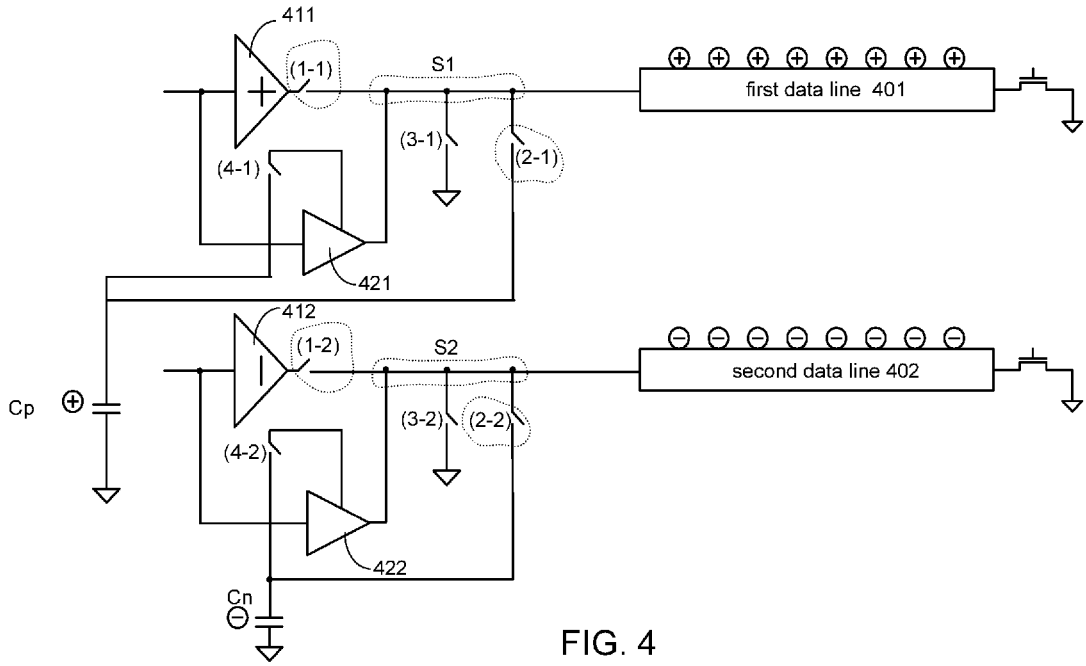
FIG. 4 is a schematic circuit diagram illustrating a control device according to another embodiment of the present invention.

FIG. 4 is a schematic circuit diagram illustrating a control device according to another embodiment of the present invention. In this embodiment, the NMOS transistor and the PMOS transistor are replaced by amplifiers. The amplifiers are used for controlling the pre-charging actions of the capacitors after the polarity inversion is performed. The numeral references, arrangements and operations of the switch sets of FIG. 4 are similar to those of FIGS. 3C and 3D, and are not redundantly described herein.

As shown in FIG. 4, the control device includes plural voltage driving units, plural data lines, plural switch sets, and plural amplifiers. For clarification and brevity, only a first amplifier 421 and a second amplifier 422 are shown in FIG. 4. The functions of the first amplifier 421 and the second amplifier 422 are similar to those of the NMOS transistor and the PMOS transistor.

The first amplifier 421 is electrically connected with the first charge storage unit Cp through the first comparison switch (4-1). The second amplifier 422 is electrically connected with the second charge storage unit Cn through the second comparison switch (4-2).

After the polarity inversion is performed, the first comparison switch (4-1) and the second comparison switch (4-2) are turned on. Consequently, the first amplifier 421 is driven according to the voltage of the second data line 402 and the second positive driving voltage in order to charge the second data line 402. In addition, the second amplifier 422 is driven according to the voltage of the first data line 401 and the second negative driving voltage in order to discharge the first data line 401.

Since the working voltage of the first amplifier 421 is provided by the first charge storage unit Cp, the time required for increasing the voltage of the second data line 402 from the ground voltage to the second positive driving voltage will be reduced. Similarly, since the working voltage of the second amplifier 422 is provided by the second charge storage unit Cn, the time required for decreasing the voltage of the first data line 401 from the ground voltage to the second negative driving voltage will be reduced.

From the above discussions about the control device of FIG. 4, the controlling method of the present invention includes the following steps.

Firstly, the first switch set (1-1, 1-2) is turned on in the first stage I, the first voltage driving unit 411 provides a first positive driving voltage to the first data line 401, and the second voltage driving unit 412 provides a first negative driving voltage to the second data line 402.

Next, the second switch set (2-1, 2-2) is turned on in the second stage II. Consequently, the first data line 401 with the first positive driving voltage transmits the positive charges to the first charge storage unit Cp, so that the first charge storage unit Cp has the positive common voltage Vp-com. In addition, the second data line 402 with the first negative driving voltage transmits the negative charges to the second charge storage unit Cn, so that the second charge storage unit Cn has the negative common voltage Vn-com. Next, the third switch set (3-1, 3-2) is turned on in the third stage III, so that the first data line 401 and the second data line 402 are both connected with the ground voltage.

Moreover, after the polarity inversion is performed, the first comparison switch (4-1) and the second comparison switch (4-2) are turned on. When the first comparison switch (4-1) is turned on, the first amplifier 421 is driven according to the voltage of the second data line 402 and the second positive driving voltage in order to charge the second data line 402. When the second comparison switch (4-2) is turned on, the second amplifier 422 is driven according to the voltage of the first data line 401 and the second negative driving voltage in order to discharge the first data line 401.

By using the first amplifier 421 and the second amplifier 422, the voltages of the first data line 401 and the second data line 402 can quickly reach the stable states. In other words, the control device of FIG. 4 can achieve the power-saving efficacy.

In the above embodiments, the first charge storage unit Cp for storing the positive charges and the second charge storage unit Cn for storing the negative charges are employed to store the charges of the data lines before the polarity inversion is performed and provide the charges to other data lines. It is noted that the number of charge storage units for storing the positive charges and the negative charges may be varied according to the practical requirements.

In the control device with the charge-sharing function, only one first charge storage unit Cp and one second charge storage unit Cn are provided for storing the positive charges and the negative charges, respectively. For example, the voltage provided by the charge storage unit for storing the positive charges is PAVDD, and the voltage provided by the charge storage unit for storing the negative charges is NAVDD. On the other hand, if number of charge storage units for storing the positive charges and the negative charges is increased, the number of common voltages provided by the charge storage units will be increased.

Figure 5A:
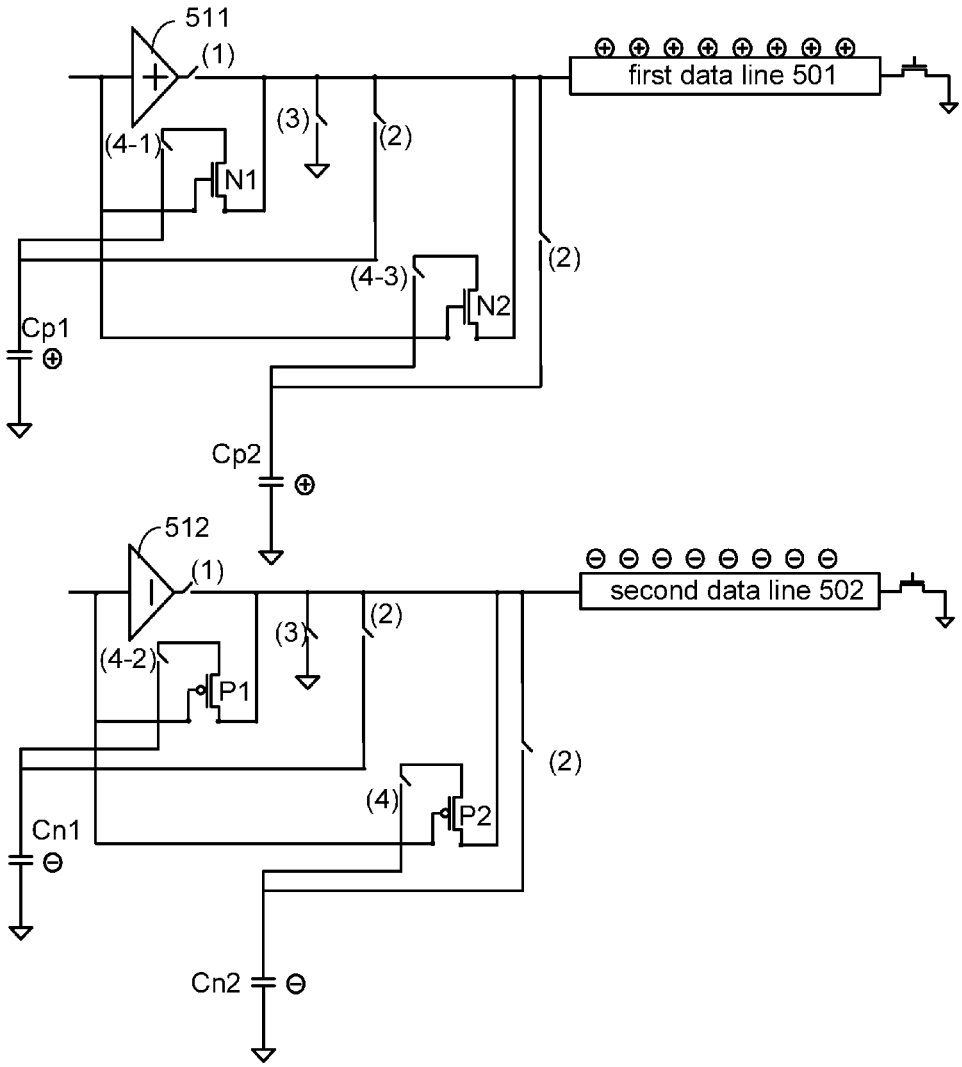
FIG. 5A is a schematic circuit diagram illustrating a control device according to another embodiment of the present invention, in which the controlling unit includes two positive charge storage units and two negative charge storage units.

FIG. 5A is a schematic circuit diagram illustrating a control device according to another embodiment of the present invention, in which the controlling unit includes two positive charge storage units and two negative charge storage units. The relationships between the switch sets, the voltage driving units and the data lines of the control device of FIG. 5A are similar to those of FIG. 3C, and are not redundantly described herein. In comparison with FIG. 3C, the control device of FIG. 5A includes two positive charge storage units Cp1, Cp2 and two negative charge storage units Cn1, Cn2.

Each of the positive charge storage units Cp1 and Cp2 is correlated with a corresponding NMOS transistor. Each of the negative charge storage units Cn1 and Cn2 is correlated with a corresponding PMOS transistor. In a case that the capacitance values of the charge storage units are different, various positive common voltages and various negative common voltages may be provided to corresponding data lines.

Figure 5B:
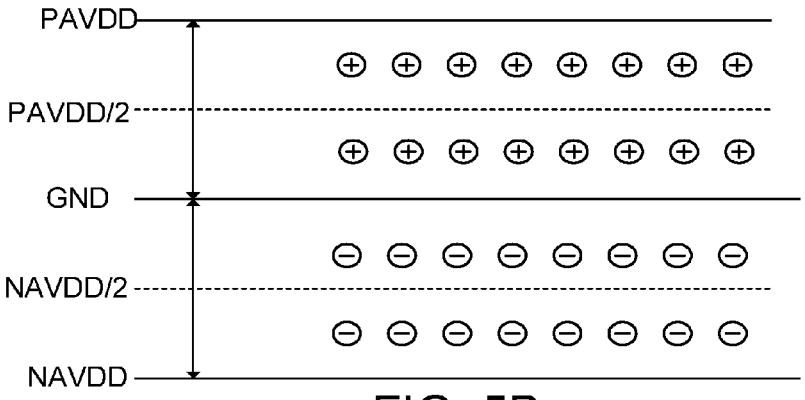
FIG. 5B schematically illustrates the voltages provided by the charge storage units of the control device of FIG. 5A.

FIG. 5B schematically illustrates the voltages provided by the charge storage units of the control device of FIG. 5A. In a case that the controlling unit includes two positive charge storage units and two negative charge storage units, the charge storage units may be selectively turned on.

Consequently, the positive driving voltage applied to the data lines may be classified into a high positive driving voltage (PAVDD/2~PAVDD) and a low positive driving voltage (GND~PAVDD/2). The data lines with the high positive driving voltage are electrically connected with the positive charge storage unit Cp1, and the data lines with the low positive driving voltage are electrically connected with the positive charge storage unit Cp2.

Similarly, the negative driving voltage applied to the data lines may be classified into a high negative driving voltage (NAVDD/2~GND) and a low negative driving voltage (NAVDD~NAVDD/2). The data lines with the high negative driving voltage are electrically connected with the negative charge storage unit Cn1. The data lines with the low negative driving voltage are electrically connected with the negative charge storage unit Cn2.

Figure 6:
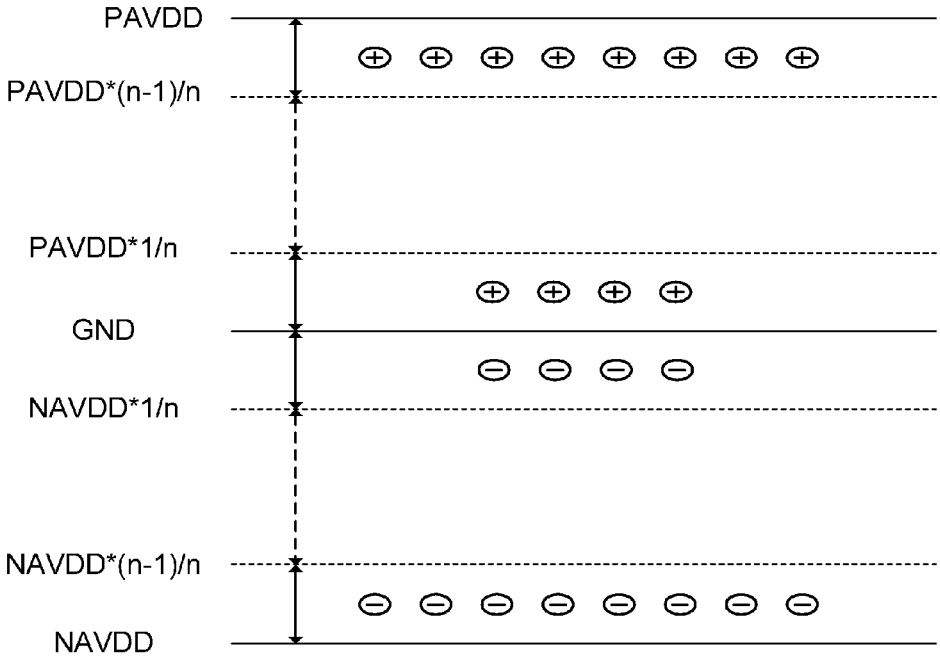
FIG. 6 schematically illustrates the voltages provided by the charge storage units of a control device including n positive charge storage units and n negative charge storage units.

FIG. 6 schematically illustrates the voltages provided by the charge storage units of a control device including n positive charge storage units and n negative charge storage units. The configurations of the controlling unit of FIG. 6 are similar to those of the control device of FIG. 5A except the control device of FIG. 6 includes n positive charge storage units and n negative charge storage units (not shown).

In this embodiment, the positive driving voltage applied to the data line may be classified into n equal portions, and the negative driving voltage applied to the data line may be classified into n equal portions. Then, respective portions of the positive driving voltage and the negative driving voltage are transmitted to different charge storage units.

For example, as shown in FIG. 6, the positive driving voltage in the range between PAVDD and GND are classified into n types of positive common voltages, i.e. GND, PAVDD*1/n, PAVDD*2/n, . . . , PAVDD*(n−1)/n and PAVDD.

Similarly, the negative driving voltage in the range between NAVDD and GND are classified into n types of negative common voltages, i.e. GND, NAVDD*1/n, NAVDD*2/n, . . . , NAVDD*(n−1)/n and NAVDD.

FIG. 7 is a schematic circuit diagram illustrating a control device for sharing charges and accelerating the charging and discharging actions according to another embodiment of the present invention.

The control device of FIG. 7 also includes a plurality of switch sets between the voltage driving units and corresponding data lines. In this embodiment, no polarity inversion is occurred between the voltage driving units and the corresponding data lines. That is, the odd-numbered driving voltage units continuously provide positive driving voltages to the odd-numbered data lines, and the even-numbered driving voltage units continuously provide negative driving voltages to the even-numbered data lines. However, these positive driving voltages and these negative driving voltages vary with time.

In comparison with the control device of FIG. 3C, the control device of FIG. 7 includes two PMOS/NMOS transistor pairs. Moreover, the display panel with the control device of FIG. 7 does not need to perform the polarity inversion. Consequently, the switch set for transmitting the remaining charges from the data lines to the ground voltage may be omitted.

In this embodiment, the control device for the display panel includes plural data lines, plural voltage driving units, plural charge storage units, plural transistor pairs, and plural switch sets.

From the above embodiments, the controlling method and the control device for the display panel according to the present invention can quickly charge and discharge the data lines and reduce the power consumption.

In accordance with the controlling method and the control device of the present invention, the data lines can be selectively charged or discharged through the uses of the transistors, the amplifiers and the switch sets according to the driving voltages provided by the voltage driving units. Consequently, the power consumption of the control device is reduced.

In accordance with the controlling method and the control device of the present invention, the display panel can accelerate the charging speed and the discharging speed according to the change of the driving voltage by using the transistor pairs and the switch sets.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A charge-sharing control method for use in a control device of a display panel, the control device comprising a first data line, a second data line, a first voltage driving unit, a second voltage driving unit, a first charge storage unit, a second charge storage unit, a first switch set, a second switch set and a third switch set, wherein a first positive driving voltage and a first negative driving voltage are respectively provided by the first voltage driving unit and the second voltage driving unit before a polarity inversion is performed, and a second positive driving voltage and a second negative driving voltage are respectively provided by the first voltage driving unit and the second voltage driving unit after the polarity inversion, wherein the charge-sharing control method comprises steps of:

(A) turning on the first switch set, wherein after the first switch set is turned on, the first voltage driving unit provides the first positive driving voltage to the first data line and the second voltage driving unit provides the first negative driving voltage to the second data line;

(B) turning on the second switch set, wherein after the second switch set is turned on, the first data line with the first positive driving voltage transmits positive charges to the first charge storage unit such that the first charge storage unit has a positive common voltage, and the second data line with the first negative driving voltage transmits negative charges to the second charge storage unit such that the second charge storage unit has a negative common voltage;

(C) turning on the third switch set, so that the first data line and the second data line are electrically connected with a ground voltage; and (D) after the polarity inversion, charging the second data line when a comparison between a voltage of the second data line and the second positive driving voltage complies with a first comparison result, and discharging the first data line when the comparison between the voltage of the first data line and the second negative driving voltage complies with a second comparison result.

2. The charge-sharing control method as claimed in claim 1, further comprising a step (E) of turning on the first switch set, wherein after the first switch set is turned on, the first voltage driving unit provides the second positive driving voltage to the second data line and the second voltage driving unit provides the second negative driving voltage to the first data line.

3. The charge-sharing control method as claimed in claim 2, wherein the step (E) comprises sub-steps of:

(E1) according to the first comparison result, selectively charging the second data line from the positive common voltage or the ground voltage to the second positive driving voltage; and (E2) according to the second comparison result, selectively discharging the first data line from the negative common voltage or the ground voltage to the second negative driving voltage.

4. The charge-sharing control method as claimed in claim 1, wherein the step (B) comprises sub-steps of:

(B1) turning on a first sub-switch of the second switch set, so that the first data line and the first charge storage unit have the positive common voltage; and (B2) turning on a second sub-switch of the second switch set, so that the second data line and the second charge storage unit have the negative common voltage.

5. The charge-sharing control method as claimed in claim 1, wherein if the second positive driving voltage is higher than the voltage of the second data line by at least a first threshold voltage, the comparison between the voltage of the second data line and the second positive driving voltage complies with the first comparison result, so that the second data line is charged by the first charge storage unit.

6. The charge-sharing control method as claimed in claim 1, wherein if the second negative driving voltage is lower than the voltage of the first data line by at least a second threshold voltage, the comparison between the voltage of the first data line and the second negative driving voltage complies with the second comparison result, so that the first data line is discharged by the second charge storage unit.

7. The charge-sharing control method as claimed in claim 1, wherein the control device further comprises:

a NMOS transistor, electrically connected with the first voltage driving unit;

a PMOS transistor electrically connected with the second voltage driving unit;

a first comparison switch electrically connected between the first charge storage unit and the NMOS transistor, wherein when the first comparison switch is turned on after the polarity inversion, and the comparison between the voltage of the second data line and the second positive driving voltage complies with the first comparison result, the NMOS transistor is turned on, so that the second data line is charged by the first charge storage unit; and a second comparison switch electrically connected between the second charge storage unit and the PMOS transistor, wherein when the second comparison switch is turned on after the polarity inversion, and the comparison between the voltage of the first data line and the second negative driving voltage complies with the second comparison result, the PMOS transistor is turned on, so that the first data line is discharged by the second charge storage unit.

8. A control device of a display panel, control device comprising:

a plurality of switch sets, comprising a first switch set, a second switch set and a third switch set, which are sequentially turned on before a polarity inversion is performed, wherein the first switch set, the second switch set and the third switch set respectively comprises a first sub-switch and a second sub-switch, wherein first ends of the first sub-switches are electrically connected with a first node, and first ends of the second sub-switches are electrically connected with a second node;

a first data line, electrically connected with the first node before the polarity inversion, and the second node after the polarity inversion, respectively;

a second data line, electrically connected with the second node before the polarity inversion, and the first node after the polarity inversion, respectively;

a first voltage driving unit, electrically connected with a second end of the first sub-switch of the first switch set, for respectively generating a first positive driving voltage before the polarity inversion and a second positive driving voltage after the polarity inversion;

a second voltage driving unit, electrically connected with a second end of the second sub-switch of the first switch set, for respectively generating a first negative driving voltage before the polarity inversion and a second negative driving voltage after the polarity inversion;

a first charge storage unit, electrically connected with a second end of the first sub-switch of the second switch set, for acquiring a positive common voltage when the second switch set is turned on;

a first comparison circuit, electrically connected with the first node, the first voltage driving unit and the first charge storage unit, wherein when a comparison between a voltage of the second data line and the second positive driving voltage complies with a first comparison result after the polarity inversion, the positive common voltage is transmitted to the first node through the first comparison circuit so as to charge the second data line;

a second charge storage unit, electrically connected with a second end of the second sub-switch of the second switch set, for acquiring a negative common voltage when the second switch set is turned on; and a second comparison circuit electrically connected with the second node, the second voltage driving unit and the second charge storage unit, wherein after the polarity inversion, when the comparison between the voltage of the first data line and the second negative driving voltage complies with a second comparison result after the polarity inversion, the negative common voltage is transmitted to the second node through the second comparison circuit so as to discharge the first data line.

9. The control device as claimed in claim 8, wherein after the polarity inversion and the first sub-switch of the first switch set is turned on, according to the first comparison result, the first voltage driving unit selectively charges the second data line from the positive common voltage or a ground voltage to the second positive driving voltage through the first node.

10. The control device as claimed in claim 8, wherein after the polarity inversion and the second sub-switch of the first switch set is turned on, according to the second comparison result, the second voltage driving unit selectively discharges the first data line from the negative common voltage or a ground voltage to the second negative driving voltage through the second node.

11. The control device as claimed in claim 8, wherein the first comparison circuit comprises:

a NMOS transistor, electrically connected with the first voltage driving unit and the first node; and a first comparison switch, electrically connected between the first charge storage unit and the NMOS transistor, being turned on after the polarity inversion, when the comparison between the voltage of the second data line and the second positive driving voltage complies with the first comparison result, the NMOS transistor is turned on, so that the positive common voltage is transmitted to the first node through the NMOS transistor to charge the second data line.

12. The control device as claimed in claim 11, wherein the NMOS transistor has a gate terminal electrically connected with the first voltage driving unit, a drain terminal electrically connected with the first comparison switch, and a source terminal electrically connected with the first node, wherein the first comparison result is complied when the second positive driving voltage is higher than the voltage of the second data line by at least a first threshold voltage, the NMOS transistor is correspondingly turned on, so that the first node is charged by the first charge storage unit, and the voltage of the second data line is increased from a ground voltage to the positive common voltage.

13. The control device as claimed in claim 8, wherein the second comparison circuit comprises:

a PMOS transistor, electrically connected with the second voltage driving unit and the second node; and a second comparison switch, electrically connected between the second charge storage unit and the PMOS transistor, being turned on after the polarity inversion, when the comparison between the voltage of the first data line and the second negative driving voltage complies with the second comparison result, the PMOS transistor is turned on, so that the negative common voltage is transmitted to the second node to discharge the first data line.

14. The control device as claimed in claim 13, wherein the PMOS transistor has a gate terminal electrically connected with the second voltage driving unit, a drain terminal electrically connected with the second comparison switch, and a source terminal electrically connected with the second node, wherein the second comparison result is complied when the second negative driving voltage is lower than the voltage of the first data line by at least a second threshold voltage, the PMOS transistor is correspondingly turned on, so that the second node is discharged by the second charge storage unit, and the voltage of the first data line is decreased from a ground voltage to the negative common voltage.

15. A charge-sharing control method for use in a control device of a display panel, the control device comprising a first data line, a second data line, a first voltage driving unit, a second voltage driving unit, a first charge storage unit, a second charge storage unit, a first switch set, a second switch set, a third switch set, a fourth switch set, a first amplifier and a second amplifier, wherein a first positive driving voltage and a first negative driving voltage are respectively provided by the first voltage driving unit and the second voltage driving unit before a polarity inversion is performed, and a second positive driving voltage and a second negative driving voltage are respectively provided by the first voltage driving unit and the second voltage driving unit after the polarity inversion, wherein the charge-sharing control method comprises steps of:

(A) turning on the first switch set, so that the first voltage driving unit provides the first positive driving voltage to the first data line and the second voltage driving unit provides the first negative driving voltage to the second data line;

(B) turning on the second switch set, so that the first data line with the first positive driving voltage transmits positive charges to the first charge storage unit such that the first charge storage unit has a positive common voltage, and the second data line with the first negative driving voltage transmits negative charges to the second charge storage unit such that the second charge storage unit has a negative common voltage;

(C) turning on the third switch set, so that the first and the second data lines are electrically connected with a ground voltage; and (D) turning on a first comparison switch and a second comparison switch of the fourth switch set after the polarity inversion, so that the first amplifier is driven according to a voltage of the second data line and the second positive driving voltage, so as to charge the second data line, and the second amplifier is driven according to a voltage of the first data line and the second negative driving voltage so as to discharge the first data line.

16. The charge-sharing control method as claimed in claim 15, further comprising a step (E) of turning on the first switch set, wherein after the first switch set is turned on, the first voltage driving unit provides the second positive driving voltage to the second data line and the second voltage driving unit provides the second negative driving voltage to the first data line.

17. The charge-sharing control method as claimed in claim 15, wherein the step (D) comprises sub-steps of:

(D1) charging the second data line by the second positive driving voltage through the first amplifier, wherein the positive common voltage is served as a working voltage of the first amplifier; and (D2) discharging the first data line by the second negative driving voltage through the second amplifier, wherein the negative common voltage is served as a working voltage of the second amplifier.

18. A control device of a display panel, comprising:

a plurality of switch sets comprising a first switch set, a second switch set and a third switch set respectively comprises a first sub-switch and a second sub-switch, wherein the first sub-switches are electrically connected with a first node, and the second sub-switches are electrically connected with a second node;

a first data line, electrically connected with the display panel, wherein the first data line is respectively and electrically connected with the first and the second nodes before and after the polarity inversion, and the first data line has a ground voltage after the third switch set is turned on;

a second data line, electrically connected with the display panel, wherein the second data line is respectively and electrically connected with the second and the first nodes before and after the polarity inversion, and the second data line has the ground voltage after the third switch set is turned on;

a first voltage driving unit, electrically connected with the first sub-switch of the first switch set, for providing a first positive driving voltage to the first data line through the first node before the polarity inversion, and a second positive driving voltage to the second data line through the first node after the polarity inversion;

a second voltage driving unit, electrically connected with the second sub-switch of the first switch set, for providing a first negative driving voltage to the second data line through the second node before the polarity inversion, and a second negative driving voltage to the first data line through the second node after the polarity inversion;

a first charge storage unit, electrically connected with the first sub-switch of the second switch set, wherein when the second switch set is turned on, positive charges are transmitted from the first data line, so that the first charge storage unit has a positive common voltage;

a second charge storage unit, electrically connected with the second sub-switch of the second switch set, wherein when the second switch set is turned on, negative charges are transmitted from the second data line, so that the second charge storage unit has a negative common voltage;

a first amplifier, electrically connected with the first node and a first comparison switch, wherein when the first comparison switch is turned on, the first amplifier is electrically connected with the first charge storage unit, wherein the first amplifier is driven according to a voltage of the second data line and the second positive driving voltage so as to charge the second data line; and a second amplifier, electrically connected with the second node and a second comparison switch, wherein when the second comparison switch is turned on, the second amplifier is electrically connected with the second charge storage unit, wherein the second amplifier is driven according to a voltage of the first data line and the second negative driving voltage so as to discharge the first data line.

* * * * *